US010142745B2

(12) United States Patent
Petersen et al.

(10) Patent No.: US 10,142,745 B2
(45) Date of Patent: Nov. 27, 2018

(54) HEARING DEVICE COMPRISING AN OWN VOICE DETECTOR

(71) Applicant: Oticon A/S, Smørum (DK)

(72) Inventors: Svend Oscar Petersen, Smørum (DK); Anders Thule, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 15/821,365

(22) Filed: Nov. 22, 2017

(65) Prior Publication Data

US 2018/0146307 A1 May 24, 2018

(30) Foreign Application Priority Data

Nov. 24, 2016 (EP) ..... 16200399

(51) Int. Cl.
*H04R 5/00* (2006.01)
*H04R 25/00* (2006.01)

(52) U.S. Cl.
CPC ..... *H04R 25/552* (2013.01); *H04R 25/554* (2013.01); *H04R 25/70* (2013.01)

(58) Field of Classification Search
CPC ..... H04R 5/00
See application file for complete search history.

(56) References Cited

U.S. PATENT DOCUMENTS 5,636,285 A * 6/1997 Sauer ..... H04R 25/507 381/312
2010/0092016 A1* 4/2010 Iwano ..... H04R 25/407 381/313
2010/0260364 A1 10/2010 Merks
2015/0043765 A1 2/2015 Merks
2015/0163602 A1 6/2015 Pedersen et al.
2015/0319546 A1* 11/2015 Sprague ..... H04R 25/65 381/312
2016/0105751 A1* 4/2016 Zurbruegg ..... H04R 25/407 381/317

(Continued)

FOREIGN PATENT DOCUMENTS

EP 1 519 625 A2 3/2005
EP 1 519 625 A3 12/2006

(Continued)

*Primary Examiner* — Olisa Anwah
(74) *Attorney, Agent, or Firm* — Birch, Stewart, Kolasch & Birch, LLP

(57) ABSTRACT

A hearing device, e.g. a hearing aid, adapted for being arranged at least partly on a user's head or at least partly implanted in a user's head is provided. The hearing device comprises an own voice detector comprising first and second signal strength detectors for providing signal strength estimates of first and second electric input signals. The own voice detector comprises a comparison unit operationally coupled to the first and second signal strength detectors and configured to compare the signal strength estimates of the first and second electric input signals and to provide an indication of the difference between said signal strength estimates; and a control unit for providing an own voice detection signal indicative of a user's own voice being present or not present in the current sound in the environment of the user, the own voice detection signal being dependent on said signal strength comparison measure.

25 Claims, 9 Drawing Sheets

(56) References Cited

U.S. PATENT DOCUMENTS

| | | | | |
|---|---|---|---|---|
| 2016/0192089 | A1* | 6/2016 | Merks | H04R 25/407<br>381/317 |
| 2016/0269834 | A1* | 9/2016 | Rosenkranz | H04R 25/505 |
| 2017/0195791 | A1* | 7/2017 | Pedersen | H04R 3/04 |
| 2017/0346920 | A1* | 11/2017 | Masaki | H04L 67/306 |

FOREIGN PATENT DOCUMENTS

| | | | |
|---|---|---|---|
| EP | 2 242 289 | A1 | 10/2010 |
| EP | 2 835 987 | A1 | 2/2015 |

* cited by examiner

HEARING DEVICE COMPRISING AN OWN VOICE DETECTOR

SUMMARY

The present application deals with hearing devices, e.g. hearing aids or other hearing devices, adapted to be worn by a user, in particular hearing devices comprising at least two (first and second) input transducers for picking up sound from the environment. One input transducer is located at or in an ear canal of the user, and at least one (e.g. two) other input transducer(s) is(are) located elsewhere on the body of the user e.g. at or behind an ear of the user (both (or all) input transducers being located at or near the same ear). The present application deals with detection of a user's (wearer's) own voice by analysis of the signals from the first and second (or more) input transducers.

A Hearing Device:

In an aspect of the present application, a hearing device, e.g. a hearing aid, adapted for being arranged at least partly on a user's head or at least partly implanted in a user's head is provided. The hearing device comprises

- an input unit for providing a multitude of electric input signals representing sound in the environment of the user,
- a signal processing unit providing a processed signal based on one or more of said multitude of electric input signals, and
- an output unit comprising an output transducer for converting said processed signal or a signal originating therefrom to a stimulus perceivable by said user as sound;
- the input unit comprising
  - at least one first input transducer for picking up a sound signal from the environment and providing respective at least one first electric input signal, and a first signal strength detector for providing a signal strength estimate of the at least one first electric input signal, termed the first signal strength estimate, the at least one first input transducer being located on the head, away from the ear canal, e.g. at or behind an ear, of the user;
  - a second input transducer for picking up a sound signal from the environment and providing a second electric input signal, and a second signal strength detector for providing a signal strength estimate of the second electric input signal, termed the second signal strength estimate, the second input transducer being located at or in an ear canal of the user.
- The hearing device further comprises
- an own voice detector comprising
  - a comparison unit operationally coupled to the first and second signal strength detectors and configured to compare the first and second signal strength estimates, and to provide a signal strength comparison measure indicative of the difference between said signal strength estimates; and
  - a control unit for providing an own voice detection signal indicative of a user's own voice being present or not present in the current sound in the environment of the user, the own voice detection signal being dependent on said signal strength comparison measure.

Thereby an alternative scheme for detecting a user's own voice is provided.

In an embodiment, the own voice detector of the hearing device is adapted to be able to differentiate between a user's own voice and another person's voice and possibly from NON-voice sounds.

In the present context, a signal strength is taken to mean a level or magnitude of an electric signal, e.g. a level or magnitude of an envelope of the electric signal, or a sound pressure or sound pressure level (SPL) of an acoustic signal.

In an embodiment, the at least one first input transducer comprises two first input transducers. In an embodiment, the first signal strength detector provides an indication the signal strength of one of the at least one first electric input signals, such as a (possibly weighted) average, or a maximum, or a minimum, etc., of the at least first electric input signals. In an embodiment, the at least one first input transducer consists of two first input transducers, e.g. two microphones, and, optionally, relevant input processing circuitry, such as input AGC, analogue to digital converter, filter bank, etc.

Level Difference:

An important aspect of the present disclosure is to compare the sound pressure level SPL (or an equivalent parameter) observed at the different microphones. When, for example, the SPL at the in-ear microphone is 2.5 dB or higher than the SPL at a behind the ear microphone, then the own voice is (estimated to be) present. In an embodiment, the signal strength comparison measure comprises an algebraic difference between the first and second signal strengths, and wherein the own voice detection signal is taken to be indicative of a user's own voice being present, when the signal strength at the second input transducer is 2.5 dB or higher than the signal strength at the at least one first input transducer. In other words, the own voice detection signal is taken to be indicative of a user's own voice being present, when the signal strength comparison measure is larger than 2.5 dB. Other signal strength comparison measures than an algebraic difference can be used, e.g. a ratio, a function of the two signal strengths, e.g. a logarithm of a ratio, etc.

In an embodiment, the own voice detection is qualified by another parameter, e.g. a modulation of a present microphone signal. This can e.g. be used to differentiate between 'own voice' and 'own noise' (e.g. due to jaw movements, snoring, etc.). In case the own voice detector indicates the presence of the user's own voice based on level differences as proposed by the present disclosure (e.g. more than 2.5 dB), and a modulation estimator indicates a modulation of one of the microphone signals corresponding to speech, own voice detection can be assumed. If, however, modulation does not correspond to speech, the level difference may be due to 'own noise' and own voice detection may not be assumed.

Frequency Bands:

In an embodiment, the hearing device comprises an analysis filter bank to provide a signal in a time-frequency representation comprising a number of frequency sub-bands. In an embodiment, the hearing device is configured to provide said first and second signal strength estimates in a number of frequency sub-bands. In an embodiment, each of the at least one first electric input signals and the second electric input signal are provided in a time-frequency representation (k,m), where k and m are frequency and time indices, respectively. Thereby processing and/or analysis of the electric input signals in the frequency domain (time-frequency domain) is enabled.

The accuracy of the detection can be improved by focusing on frequency bands where the own voice gives the greatest difference in SPL (or level, or power spectral density, or energy) between the microphones, and where the own voice has the highest SPL at the ear. This is expected to be in the low frequency range.

In an embodiment, the signal strength comparison measure is based on a difference between the first and second signal strength estimates in a number of frequency sub-bands, wherein the first and second signal strength estimates are weighted on a frequency band level. In an embodiment, $SSCM=\Sigma_{k=1}^{K} w_k(IN_2(k)-IN_1(k))$, where $IN_1$ and $IN_2$ represent the first and second electric input signals (e.g. their signal strengths. e.g. their level or magnitude), respectively, k is a frequency sub-band index (k=1, . . . , K, where K is the number of frequency sub-bands), and $w_k$ are frequency sub-band dependent weights. In an embodiment, $\Sigma_{k=1}^{K} w_k=1$. In an embodiment, the lower lying frequency sub-bands ($k\leq k_{th}$) are weighted higher than the higher lying frequency sub-bands ($k>k_{th}$), where $k_{th}$ is a threshold frequency sub-band index defining a distinction between lower lying and high lying frequencies. In an embodiment, the lower lying frequencies comprise (or is constituted by) frequencies lower than 4 kHz, such as lower than 3 kHz, such as lower than 2 kHz, such as lower than 1.5 kHz. In an embodiment, the frequency dependent weights are different for the first and second electric input signals ($w_{1k}$ and $w_{2k}$, respectively). The accuracy of the detection can be improved by focusing on the frequency bands, where the own voice gives the greatest difference in SPL between the two microphones, and where the own voice has the highest SPL at the ear. This is generally expected to be in the low frequency range, whereas the level difference between the first and second input transducers is greater around 3-4 kHz. In an embodiment, a preferred frequency range providing maximum difference in signal strength between the first and second input transducers is determined for the user (e.g. pinna size and form) and hearing device configuration in question (e.g. distance between first and second input transducer). Hence, frequency bands including a, possibly customized, preferred frequency range providing maximum difference in signal strength between the first and second input transducers (e.g. around 3-4 kHz) may be weighted higher than other frequency bands in the signal strength comparison measure, or be the only part of the frequency range considered in the signal strength comparison measure.

Voice Activity Detection:

A modulation Index can be used to detect if voice is present. This will remove false detection from e.g. 'own noises' like chewing, handling noise, etc. This will make the detection more robust. In an embodiment, the hearing device comprises a modulation detector for providing a measure of modulation of a current electric input signal, and wherein the own voice detection signal is dependent on said measure of modulation in addition to said signal strength comparison measure. The modulation detector may e.g. be applied to one or more of the input signals, e.g. the second electric input signal, or to a beamformed signal, e.g. a beamformed signal focusing on the mouth of the user.

Adaptive Algorithm:

In an embodiment, the own voice detector comprises an adaptive algorithm for a better detection of the users own voice. In an embodiment, the hearing device comprises a beamformer filtering unit, e.g. comprising an adaptive algorithm, for providing a spatially filtered (beamformed) signal. In an embodiment, the beamformer filtering unit is configured to focus on the user's mouth, when the users own voice is estimated to be detected by the own voice detector. Thereby the confidence of the estimate of the presence (or absence) of the user's own voice can be further improved. In an embodiment, the beamformer filtering unit comprises a pre-defined and/or adaptively updated own voice beamformer focused on the user's mouth. In an embodiment, the beamformer filtering unit receives the first as well as the second electric input signals, e.g. corresponding to signals from a microphone in the ear and a microphone located elsewhere, e.g. behind the ear (with a mutual distance of more than 10 mm, e.g. more than 40 mm), whereby the focus of the beamformed signal can be relatively narrow. In an embodiment, the hearing device comprises a beamformer filtering unit configured to receive said at least one first electric input signal(s) and said second electric input signal and to provide a spatially filtered signal in dependence thereof. In an embodiment, a user's own voice is assumed to be detected, when adaptive coefficients of the beamformer filtering unit match expected coefficients for own voice. Such indication may be used to qualify the own voice detection signal based on the signal strength comparison measure. In an embodiment, the beamformer filtering unit comprises an MVDR beamformer. In an embodiment, the hearing device is configured to use the own voice detection signal to control the beamformer filtering unit to provide a spatially filtered (beamformed) signal. The own voice beamformer may be always (or in specific modes) activated (but not always (e.g. never) listened to (presented to the user)) and ready to be tapped to (provide) an estimate of the user's own voice, e.g. for transmission to another device during a telephone mode, or in other modes, where a user's own voice is requested.

Voice Activation. Key Word Detection:

The hearing device may comprise a voice interface. In an embodiment, the hearing device is configured to detect a specific voice activation word or phrase or sound, e.g. 'Oticon' or 'Hi Oticon' (or any other pre-determined or otherwise selected, e.g. user configurable, word or phrase, or well-defined sound). The voice interface may be activated by the detection of the specific voice activation word or phrase or sound. The hearing device may comprise a voice detector configured to detected a limited number of words or commands ('key words'), including the specific voice activation word or phrase or sound. In an embodiment, the voice detector comprises a neural network. In an embodiment, the voice detector is configured to be trained to the user's voice, while speaking at least some of said limited number of words.

The hearing device may be configured to allow a user to activate and/or deactivate one or more specific modes of operation of the hearing device via the voice interface. In an embodiment, the one or more specific modes operation comprise(s) a communication mode (e.g. a telephone mode), where the user's own voice is picked up by the input transducers of the hearing device, e.g. by an own voice beamformer, and transmitted via a wireless interface to a communication device (e.g. a telephone or a PC). Such mode of operation may e.g. be initiated by a specific spoken (activation) command (e.g. 'telephone mode') following the voice interphase activation phrase (e.g. 'Hi Oticon'). In this mode of operation, the hearing device may be configured to wirelessly receive an audio signal from a communication device, e.g. a telephone. The hearing device may be configured to allow a user to deactivate a current mode of operation via the voice interface by a spoken (de-activation) command (e.g. 'normal mode') following the voice interface activation phrase (e.g. 'Hi Oticon'). The hearing device may be configured to allow a user to activate and/or deactivate a personal assistant of another device via the voice interface of the hearing device. Such mode of operation, e.g. termed 'voice command mode' (and activated by corresponding spoken words), to activate a mode of operation where the user's voice is transmitted to a voice interface of another device, e.g. a smartphone, and activating a voice interface of the other device, e.g. to ask a question to a voice activated personal assistant provided by the other device, e.g. a smartphone. Examples of such voice activated personal assistants are 'Siri' of Apple smartphones, 'Genie' for Android based smartphones, or 'Google Now' for Google applications. The outputs (questions replies) from the personal assistant of the auxiliary device are forwarded as audio to the hearing device and fed to the output unit (e.g. a loudspeaker) and presented to the user perceivable as sound. Thereby the user's interaction with the personal assistant of the auxiliary device (e.g. a smartphone or a PC) can be fully based on voice input and audio output (i.e. no need to look at a display or enter data via key board).

Streaming and Own Voice Pick-Up:

In an embodiment, the hearing device is configured to—e.g. in a specific wireless sound receiving mode of operation (where audio signals are wirelessly received by the hearing device from another device)—allow a (hands free) streaming of own voice to the other device, e.g. a mobile telephone, including to pick up and transmit a user's own voice to such other (communication) device (cf. e.g. US20150163602A1). In an embodiment, a beamformer filtering unit is configured to enhance the own voice of the user, e.g. by spatially filtering noises from some directions away from desired (e.g. own voice) signals in other directions in the hands free streaming situation.

Self Calibrating Beam Former:

In an embodiment, the beamformer filtering unit is configured to self-calibrate in the hands free streaming situation (e.g. in the specific wireless sound receiving mode of operation) where we know that the own voice is present (in certain time ranges, e.g. of a telephone conversation). So, in an embodiment, the hearing device is configured to update beamformer filtering weights (e.g. of a MVDR beamformer) of the beamformer filtering unit while the user is talking to thereby calibrate the beamformer to steer at the users mouth (to pick up the user's own voice).

Self Learning Own Voice Detection:

To make the hearing device better at detecting the users own voice, the system could over time adapt to the users own voice by learning the parameters or characteristics of the users own voice, and the parameters or characteristics of the users own voice in different sound environments. The problem here could be to know when to adapt. A solution could be only to adapt the parameters of the own voice, while the users is streaming a phone call through the hearing device. In this situation, it is sure to say that the user is speaking. Additionally, it would also be a good assumption that the user will not be speaking when the person in the other end of the phone line is speaking.

In an embodiment, the hearing device comprises an analysis unit for analyzing a user's own voice and for identifying characteristics thereof. Characteristics of the user's own voice may e.g. comprise fundamental frequency, frequency spectrum (typical distribution of power over frequency hands, dominating frequency bands, etc.), modulation depth, etc.). In an embodiment, such characteristics are used as inputs to the own voice detection, e.g. to determine one or more frequency bands to focus own voice detection in (and/or to determine weights of the signal strength comparison measure).

In an embodiment, the hearing device comprises a hearing aid, a headset, an ear protection device or a combination thereof.

RITE Style Benefit:

In an embodiment, the hearing device comprises a part (ITE part) comprising a loudspeaker (also termed 'receiver') adapted for being located in an ear canal of the user and a part (BTE-part) comprising a housing adapted for being located behind or at an ear (e.g. pinna) of the user, where a first microphone is located (such device being termed a 'RITE style' hearing device in the present disclosure, RITE being short for 'Receiver in the ear'). This has the advantage that detecting the users own voice—having a microphone behind the ear and a microphone in or at the ear canal—will be easier and more reliable according to the present disclosure. A RITE style hearing instrument already has an electrically connecting element (e.g. comprising a cable and a connector) for connecting electronic circuitry in the BTE with (at least) the loudspeaker in the ITE unit, so adding a microphone to the ITE unit, will only require extra electrical connections to the existing connecting element.

In an embodiment, the hearing device comprises a part, the ITE part, comprising a loudspeaker and said second input transducer, wherein the ITE part is adapted for being located in an ear canal of the user and a part, the BTE-part, comprising a housing adapted for being located behind or at an ear (e.g. pinna) of the user, where a first input transducer is located. In an embodiment, the first and second input transducers each comprise a microphone.

TF-Masking Used to Enhance Own Voice:

An alternative way to enhancing the users own voice can be a Time-Frequency masking technique. Where the sound pressure level at the in the ear microphone is more than 2 dB higher than the level of the behind the ear microphone, then the gain is turned up, and otherwise the gain is turned down. This can be applied individually in each frequency band for better performance. In an embodiment, the hearing aid is configured to enhance a user's own voice by applying a gain factor larger than 1 in time-frequency tiles (k,m), for which a difference between the first and second signal strengths is larger than 2 dB.

Own Voice Comfort:

Another use case for applying the detected own voice could be for improving the own voice comfort. Many users complain that their own voice is amplified too much. The OV detection could be used to turn down the amplification while the user is speaking. In an embodiment, the hearing device is configured to attenuate a user's own voice by applying a gain factor smaller than 1 when said signal strength comparison measure is indicative of the user's own voice being present. In an embodiment, the hearing device is configured to attenuate a user's own voice by applying a gain factor smaller than 1 in time-frequency tiles (k,m), for which a difference between the first and second signal strengths is larger than 2 dB.

The own voice detector may comprise a controllable vent, e.g. allowing an electronically controllable vent size. In an embodiment, the own voice detector is used to control a vent size of the hearing device (e.g. so that a vent size is increased when a user's own voice is detected; and decreased again when the user's own voice is not detected (to minimize a risk of feedback and/or provide sufficient gain)). An electrically controllable vent is e.g. described in EP2835987A1.

In an embodiment, the hearing device is adapted to provide a frequency dependent gain and/or a level dependent compression and/or a transposition (with or without frequency compression) of one or frequency ranges to one or more other frequency ranges, e.g. to compensate for a hearing impairment of a user. In an embodiment, the hearing device comprises a signal processing unit for enhancing the input signals and providing a processed output signal.

In an embodiment, the output unit is configured to provide a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the input unit comprises a wireless receiver for receiving a wireless signal comprising sound and for providing an electric input signal representing said sound. In an embodiment, the hearing device comprises a directional microphone system adapted to enhance a target acoustic source among a multitude of acoustic sources in the local environment of the user wearing the hearing device. In an embodiment, the directional system is adapted to detect (such as adaptively detect) from which direction a particular part of the microphone signal originates.

In an embodiment, the hearing device comprises an antenna and transceiver circuitry for wirelessly receiving a direct electric input signal from another device, e.g. a communication device or another hearing device. In an embodiment, the hearing device comprises a (possibly standardized) electric interface (e.g. in the form of a connector) for receiving a wired direct electric input signal from another device, e.g. a communication device or another hearing device. In an embodiment, the direct electric input signal represents or comprises an audio signal and/or a control signal and/or an information signal. In an embodiment, the hearing device comprises demodulation circuitry for demodulating the received direct electric input to provide the direct electric input signal representing an audio signal and/or a control signal e.g. for setting an operational parameter (e.g. volume) and/or a processing parameter of the hearing device. In general, a wireless link established by a transmitter and antenna and transceiver circuitry of the hearing device can be of any type. In an embodiment, the wireless link is used under power constraints, e.g. in that the hearing device is or comprises a portable (typically battery driven) device. In an embodiment, the wireless link is a link based on (non-radiative) near-field communication, e.g. an inductive link based on an inductive coupling between antenna coils of transmitter and receiver parts. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying), e.g. MSK (minimum shift keying), or QAM (quadrature amplitude modulation).

In an embodiment, the communication between the hearing device and the other device is in the base band (audio frequency range, e.g. between 0 and 20 kHz). Preferably, communication between the hearing device and the other device is based on some sort of modulation at frequencies above 100 kHz. Preferably, frequencies used to establish a communication link between the hearing device and the other device is below 50 GHz, e.g. located in a range from 50 MHz to 50 GHz, e.g. above 300 MHz, e.g. in an ISM range above 300 MHz, e.g. in the 900 MHz range or in the 2.4 GHz range or in the 5.8 GHz range or in the 60 GHz range (ISM=Industrial, Scientific and Medical, such standardized ranges being e.g. defined by the International Telecommunication Union, ITU). In an embodiment, the wireless link is based on a standardized or proprietary technology. In an embodiment, the wireless link is based on Bluetooth technology (e.g. Bluetooth Low-Energy technology).

In an embodiment, the hearing device has a maximum outer dimension of the order of 0.15 m (e.g. a handheld mobile telephone). In an embodiment, the hearing device has a maximum outer dimension of the order of 0.08 m (e.g. a head set). In an embodiment, the hearing device has a maximum outer dimension of the order of 0.04 m (e.g. a hearing instrument).

In an embodiment, the hearing device is portable device, e.g. a device comprising a local energy source, e.g. a battery, e.g. a rechargeable battery.

In an embodiment, the hearing device comprises a forward or signal path between an input transducer (microphone system and/or direct electric input (e.g. a wireless receiver)) and an output transducer. In an embodiment, the signal processing unit is located in the forward path. In an embodiment, the signal processing unit is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, the hearing devices comprise an analogue-to-digital (AD) converter to digitize an analogue input with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. In an embodiment, a signal of the forward and/or analysis path of the hearing device is split into a number NI of (e.g. uniform) frequency bands, where NI is e.g. larger than 5, such as larger than 10, such as larger than 50, such as larger than 100, such as larger than 500. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g. the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate(s) on band split signals ((time-) frequency domain).

In an embodiment, the number of detectors comprises a level detector for estimating a current level of a signal of the forward path. In an embodiment, the predefined criterion comprises whether the current level of a signal of the forward path is above or below a given (L-)threshold value.

In a particular embodiment, the hearing device comprises a voice detector (VD) for determining whether or not an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic;

b) the current acoustic situation (input level, feedback, etc.), and c) the current mode or state of the user (movement, temperature, etc.);

d) the current mode or state of the hearing device (program selected, time elapsed since last user interaction, etc.) and/or of another device in communication with the hearing device.

In an embodiment, the hearing device comprises an acoustic (and/or mechanical) feedback suppression system. Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together, as e.g. in hearing aids or other audio systems. Some other classic situations with feedback problem are telephony, public address systems, headsets, audio conference systems, etc. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the hearing device further comprises other relevant functionality for the application in question, e.g. compression, noise reduction, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising one or more hearing aids, e.g. hearing instruments, headsets, ear phones, active ear protection systems, etc., e.g. in handsfree telephone systems, teleconferencing systems, public address systems, karaoke systems, classroom amplification systems, etc.

A Method:

In an aspect, a method of detecting a user's own voice in a hearing device is furthermore provided by the present application. The method comprises

- providing a multitude of electric input signals representing sound in the environment of the user, including
  - providing at least one first electric input signal from at least one first input transducer located on the head, away from the ear canal, e.g. at or behind an ear, of the user; and
  - providing a second electric input signal from a second input transducer located at or in an ear canal of the user;
- providing a processed signal based on one or more of said multitude of electric input signals, and
- converting said processed signal or a signal originating therefrom to a stimulus perceivable by said user as sound;
- providing a signal strength estimate of the at least one first electric input signal, termed the first signal strength estimate;
- providing a signal strength estimate of the second electric input signal, termed the second signal strength estimate;

comparing the first and second signal strength estimates, and providing a signal strength comparison measure indicative of the difference between said signal strength estimates; and providing an own voice detection signal indicative of a user's own voice being present or not present in the current sound in the environment of the user, the own voice detection signal being dependent on said signal strength comparison measure.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the system is adapted to establish a communication link between the hearing device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

In an embodiment, the auxiliary device is another hearing device. In an embodiment, the hearing system comprises two hearing devices adapted to implement a binaural hearing system, e.g. a binaural hearing aid system.

In a further aspect, a binaural hearing system comprising first and second hearing devices as described above, in the 'detailed description of embodiments', and in the claims, wherein each of the first and second hearing devices comprises antenna and transceiver circuitry allowing a communication link between them to be to established. Thereby information (e.g. control and status signals, and possibly audio signals), including data related to own voice detection can be exchanged or forwarded from one to the other.

In an embodiment, the hearing system comprises an auxiliary device, e.g. audio gateway device for providing an audio signal to the hearing device(s) of the hearing system, or a remote control device for controlling functionality and operation of the hearing device(s) of the hearing system. In an embodiment, the function of a remote control is implemented in a SmartPhone, the SmartPhone possibly running an APP allowing to control the functionality of the audio processing device via the SmartPhone. In an embodiment, the hearing device(s) of the hearing system comprises an appropriate wireless interface to the auxiliary device, e.g. to a SmartPhone. In an embodiment, the wireless interface is based on Bluetooth (e.g. Bluetooth Low Energy) or some other standardized or proprietary scheme.

Binaural Symmetry:

For further improvement of the detection accuracy, the binaural symmetry information can be included. The own voice must be expected to be present at both hearing devices at same SPL and with more or less the same level difference between the two microphones of the individual hearing devices. This may reduce false detections from external sounds.

Calibration/Learn Your Voice:

For the optimal detection of the individual users own voice, the system can be calibrated either at the hearing care professional (HCP) or by the user. The calibration can optimize the system with the position of the microphone on the users ear, as well as the characteristics of the users own voice, i.e. level, speed and frequency shaping of the voice.

At the HCP it can be part of the fitting software where the user is asked to speak while the system is calibrating the parameters for detecting own voice. The parameters could be any of the mentioned detection methods, like microphone level difference, level difference in the individual frequency bands, binaural symmetry, VAD (by other principles than level differences, e.g. modulation), beamformer filtering unit (e.g. e.g. an own-voice beamformer, e.g. including an adaptive algorithm of the beamformer filtering unit).

In an embodiment, a hearing system is configured to allow a calibration to be performed by a user through a smartphone app, where the user presses 'calibrate own voice' in the app, e.g. while he or she is speaking.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

In an embodiment, the non-transitory application comprises a non-transitory storage medium storing a processor-executable program that, when executed by a processor of an auxiliary device, implements a user interface process for a hearing device or a binaural hearing system including left and right hearing devices, the process comprising:

exchanging information with the hearing device or with the left and right hearing devices;

providing a graphical interface configured to allow a user calibrate an own voice detector of the hearing device or of the binaural hearing system; and executing, based on input from a user via the user interface, at least one of:

configuring the own voice detector; and initiating a calibration of the own voice detector.

In an embodiment, the APP is configured to allow a calibration of own voice detection, e.g. including a learning process involving identification of characteristics of a user's own voice. In an embodiment, the APP is configured to allow a calibration of an own voice beamformer of a beamformer filtering unit.

Definitions:

The 'near-field' of an acoustic source is a region close to the source where the sound pressure and acoustic particle velocity are not in phase (wave fronts are not parallel). In the near-field, acoustic intensity can vary greatly with distance (compared to the far-field). The near-field is generally taken to be limited to a distance from the source equal to about a wavelength of sound. The wavelength $\lambda$ of sound is given by $\lambda=c/f$, where c is the speed of sound in air (343 m/s, @ 20° C.) and f is frequency. At f=1 kHz, e.g., the wavelength of sound is 0.343 m (i.e. 34 cm). In the acoustic 'far-field', on the other hand, wave fronts are parallel and the sound field intensity decreases by 6 dB each time the distance from the source is doubled (inverse square law).

In the present context, a 'hearing device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing device may comprise a single unit or several units communicating electronically with each other.

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit for processing the input audio signal and an output means for providing an audible signal to the user in dependence on the processed audio signal. In some hearing devices, an amplifier may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output means may comprise an output transducer, such as e.g. a loudspeaker for providing an air-borne acoustic signal or a vibrator for providing a structure-borne or liquid-borne acoustic signal. In some hearing devices, the output means may comprise one or more output electrodes for providing electric signals.

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. SmartPhones), public-address systems, car audio systems or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person.

Embodiments of the disclosure may e.g. be useful in applications such as hearing aids, headsets, active ear protection systems, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIG. 6A illustrates a user, a binaural hearing aid system and an auxiliary device during a calibration procedure of the own voice detector, and FIG. 6B illustrates the auxiliary device running an APP for initiating the calibration procedure.

The figures are schematic and simplified for clarity, and they just show details which are essential to the understanding of the disclosure, while other details are left out. Throughout, the same reference signs are used for identical or corresponding parts.

Figure 1A:
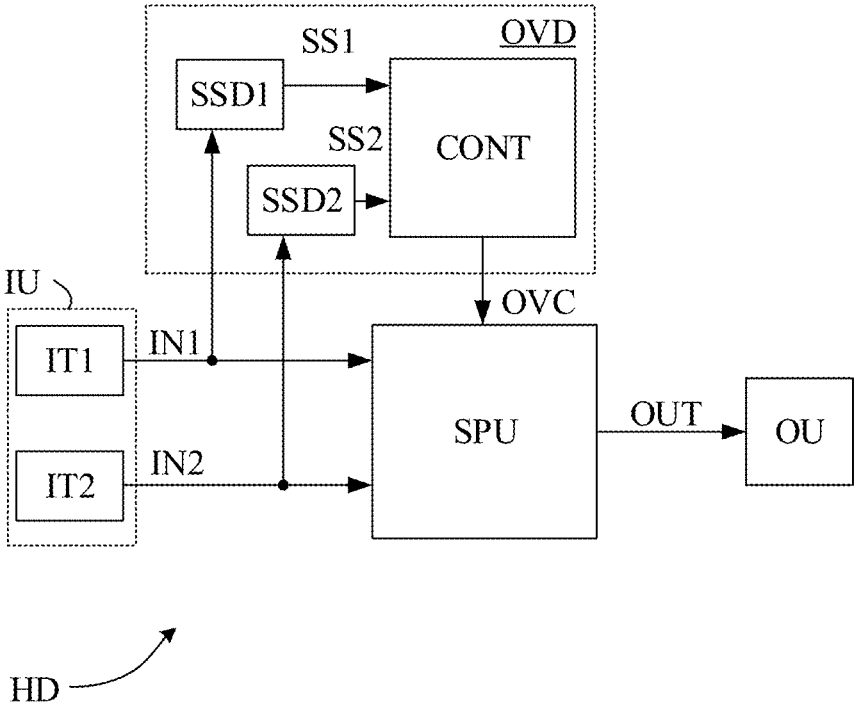
FIG. 1A shows a first embodiment of a hearing device according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present disclosure deals with own voice detection in a hearing aid with one microphone located at or in the ear canal and one microphone located away from the ear canal, e.g. behind the ear.

There are several advantages in being able to detect your own voice and/or pick up your own voice with the hearing aid. Own voice detection can be used to ensure that the level of the users' own voice has the correct gain. Hearing aid users often complain that the level of their own voice is either too high or too low. The own voice can also affect the automatics of the hearing instrument, since the signal-to-noise ratio (SNR) during own voice speech is usually high. This can cause the hearing aid to unintentionally toggle between listening modes controlled by SNR. Another problem is how to pick up the users own voice, to be used for streaming during a hands free phone call.

The sound from the mouth is in the acoustical near field range at the microphone locations of any type of hearing aid, so the sound level will differ at the two microphone locations. This will be particularly conspicuous in the M2RITE style, however, where there will be a larger difference in the sound level at the two microphones than in conventional BTE, RITE or ITE-styles. On top of this the pinna will also create a shadow of the sound approaching from the front, which is the case of own voice, in particular in the higher frequency ranges.

US20100260364A1 deals with an apparatus configured to be worn by a person, and including a first microphone adapted to be worn about the ear of the person, and a second microphone adapted to be worn at a different location than the first microphone. The apparatus includes a sound processor adapted to process signals from the first microphone to produce a processed sound signal, a receiver adapted to convert the processed sound signal into an audible signal to the wearer of the hearing assistance device, and a voice detector to detect the voice of the wearer. The voice detector includes an adaptive filter to receive signals from the first microphone and the second microphone.

FIG. 1A-1D shows four embodiments of a hearing device (HD) according to the present disclosure. Each of the embodiments of a hearing device (HD) comprises a forward path comprising an input unit (IU) for providing a multitude (at least two) of electric input signals representing sound from the environment of the hearing device, a signal processing unit (SPU) for processing the electric input signals and providing a processed output signal to an output unit (OU) for presenting a processed version of the inputs signals as stimuli perceivable by a user as sound. The hearing device further comprises an analysis path comprising an own voice detector (OVD) for continuously (repeatedly) detecting whether a user's own voice is present in one or more of the electric input signals at a given point in time.

In the embodiment of FIG. 1A, the input unit comprises a first input transducer (IT1), e.g. a first microphone, for picking up a sound signal from the environment and providing a first electric input signal (IN1), and a second input transducer (IT2), e.g. a second microphone, for picking up a sound signal from the environment and providing a second electric input signal (IN2). The first input transducer (IT1) is e.g. adapted for being located behind an ear of a user (e.g. behind pinna, such as between pinna and the skull). The second input transducer (IT2) is adapted for being located in an ear of a user, e.g. near the entrance of an ear canal (e.g. at or in the ear canal or outside the ear canal, e.g. in the concha part of pinna). The hearing device (HD) further comprises a signal processing unit (SPU) for providing a processed (preferably enhanced) signal (OUT) based (at least) on the first and/or second electric input signals (IN1, IN2). The signal processing unit (SPU) may be located in a body-worn part (BW), e.g. located at an ear, but may alternatively be located elsewhere, e.g. in another hearing device, e.g. in an audio gateway device, in a remote control device, and/or in a SmartPhone (or similar device, e.g. a tablet computer or smartwatch). The hearing device (HD) further comprises an output unit (OU) comprising an output transducer (OT), e.g. a loudspeaker, for converting the processed signal (OUT) or a further processed version thereof to a stimulus perceivable by the user as sound. The output transducer (OT) is e.g. located in an in-the-ear part (ITE) of the hearing device adapted for being located in the ear of a user, e.g. in the ear canal of the user, e.g. as is customary in a RITE-type hearing device. The signal processing unit (SPU) is located in the forward path between the input and output units (here operationally connected to the input transducers (IT1, IT2) and to the output transducer (OT)). A first aim of the location of the first and second input transducers is to allow them to pick up sound signals in the acoustic near-field from the user's mouth. A further aim of the location of the second input transducer is to allow it to pick up sound signals that include the cues resulting from the function of pinna (e.g. directional cues) in an signal from the acoustic far-field (e.g. from a signal source that is farther away from the user than 1 m). The hearing device (HD) further comprises an own voice detector (OVD) comprising first and second detectors of signal strength (SSD1, SSD2) (e.g. level detectors) for providing estimates of signal strength (SS1, SS2, e.g. level estimates) of the first and second electric input signals (IN1, IN2). The own voice detector further comprises a control unit (CONT) operationally coupled to the first and second signal strength detectors (SSD1, SSD2) and to the signal processing unit, and configured to compare the signal strength estimates (SS1, SS2) of the first and second electric input signals (IN1, IN2) and to provide a signal strength comparison measure indicative of the difference (S2–S1) between the signal strength estimates (S1, S2). The control unit (CONT) is further configured to provide an own voice detection signal (OVC) indicative of a user's own voice being present or not present in the current sound in the environment of the user, the own voice detection signal being dependent on said signal strength comparison measure. The own voice detection signal (OVC) may e.g. provide a binary indication of the current acoustic environment of the hearing devices as 'dominated by a user's own voice' or as 'not dominated by the user's own voice'. Alternatively, the own voice detection signal (OVC) may be indicative of a probability of the current acoustic environment of the hearing device comprising a user's own voice'.

The embodiment of FIG. 1A comprises two input transducers (IT1, IT2). The number of input transducers may be larger than two (IT1, . . . , ITn, n being any size that makes sense from a signal processing point of view, e.g. 3 or 4), and may include input transducers of a mobile device, e.g. a SmartPhone or even fixedly installed input transducers (e.g. in a specific location, e.g. in a room) in communication with the signal processing unit.

Each of the input transducers of the input unit (IU) of FIG. 1A to 1D can theoretically be of any kind, such as comprising a microphone (e.g. a normal (e.g. omni-directional) microphone or a vibration sensing bone conduction microphone), or an accelerometer, or a wireless receiver. The embodiments of a hearing device (HD) of FIGS. 1C and 1D each comprises three input transducers (IT11, IT12, IT2) in the form of microphones (e.g. omni-directional microphones).

Each of the embodiments of a hearing device (HD) comprises an output unit (OU) comprising an output transducer (OT) for converting a processed output signal to a stimulus perceivable by the user as sound. In the embodiments of a hearing device (HD) of FIGS. 1C and 1D, the output transducer is shown as a receiver (loudspeaker). A receiver can e.g. be located in an ear canal (RITE-type (Receiver-In-The-ear) or a CIC (completely in the ear canal-type) hearing device) or outside the ear canal (e.g. a BTE-type hearing device), e.g. coupled to a sound propagating element (e.g. a tube) for guiding the output sound from the receiver to the ear canal of the user (e.g. via an ear mould located at or in the ear canal). Alternatively, other output transducers can be envisioned, e.g. a vibrator of a bone anchored hearing device.

Figure 1B:
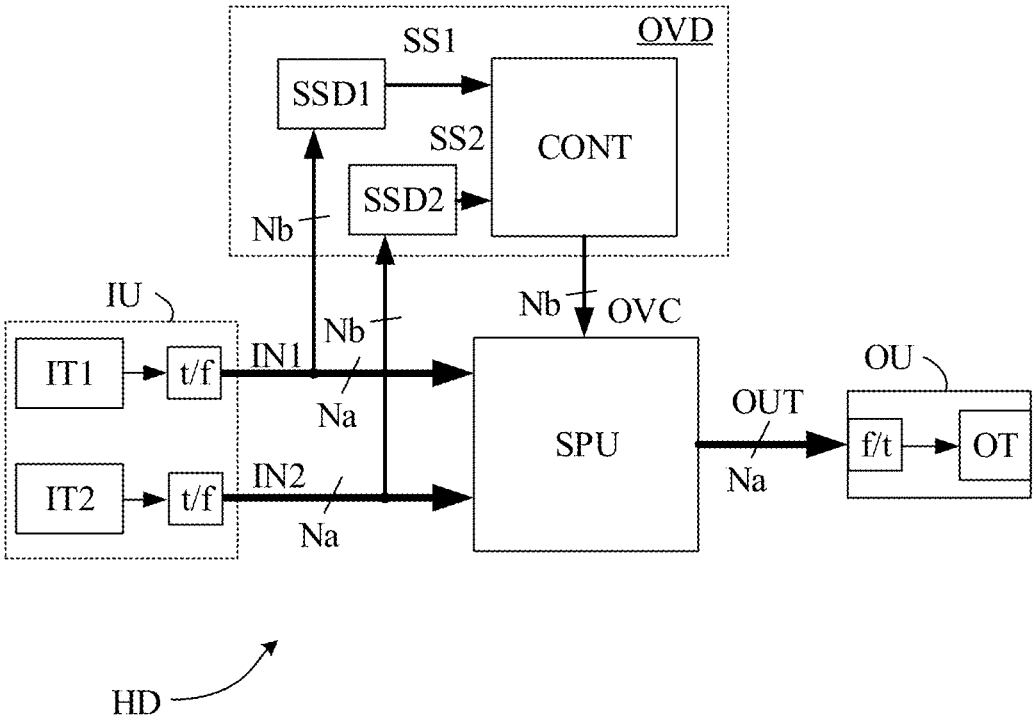
FIG. 1B shows a second embodiment of a hearing device according to the present disclosure.

The 'operational connections' between the functional elements signal processing unit (SPU), input transducers (IT1, IT2 in FIG. 1A, 1B; IT11, IT12, IT2 in FIG. 1C, 1D), and output transducer (OT)) of the hearing device (HD) can be implemented in any appropriate way allowing signals to the transferred (possibly exchanged) between the elements (at least to enable a forward path from the input transducers to the output transducer, via (and possibly in control of) the signal processing unit). The solid lines (denoted IN1, IN2, IN11, IN12, SS1, SS2, SS11, SS12, FBM, OUT) generally represent wired electric connections. The dashed zig-zag line (denoted WL in FIG. 1D) represent non-wired electric connections, e.g. wireless connections, e.g. based on electromagnetic signals, in which case the inclusion of relevant antenna and transceiver circuitry is implied). In other embodiments, one or more of the wired connections of the embodiments of FIGS. 1A to 1D may be substituted by wireless connections using appropriate transceiver circuitry, e.g. to provide partition of the hearing device or system optimized to a particular application. One or more of the wireless links may be based on Bluetooth technology (e.g. Bluetooth Low-Energy or similar technology). Thereby a large bandwidth and a relatively large transmission range is provided. Alternatively or additionally, one or more of the wireless links may be based on near-field, e.g. capacitive or inductive, communication. The latter has the advantage of having a low power consumption.

The hearing device (here e.g. the signal processing unit) may e.g. further comprise a beamforming unit comprising a directional algorithm for providing an omni-directional signal or—in a particular DIR mode—a directional signal based on one or more of the electric input signals (IN1, IN2; or IN11, IN12, IN2). In such case, the signal processing unit (SPU) is configured to provide and further process the beamformed signal, and for providing a processed (preferably enhanced) output signal (OUT), cf. e.g. FIG. 3. In an embodiment, the own voice detection signal (OVC) is used as an input to the beamforming unit, e.g. to control or influence a mode of operation of the beamforming unit (e.g. between a directional and an omni-directional mode of operation). The signal processing unit (SPU) may comprise a number of processing algorithms, e.g. a noise reduction algorithm, and/or a gain control algorithm, for enhancing the beamformed signal according to a user's needs to provide the processed output signal (OUT). The signal processing unit (SPU) may e.g. comprise a feedback cancellation system (e.g. comprising one or more adaptive filters for estimating a feedback path from the output transducer to one or more of the input transducers). In an embodiment, the feedback cancellation system may be configured to use the own voice detection signal (OVC) to activate or deactivate a particular FEEDBACK mode (e.g. in a particular frequency band or overall). In the FEEDBACK mode, the feedback cancellation system is used to update estimates of the respective feedback path(s) and to subtract such estimate(s) from the respective input signal(s) (IN1, IN2; or In11, IN12, IN2) to thereby reduce (or cancel) the feedback contribution in the input signal(s).

All embodiments of a hearing device are adapted for being arranged at least partly on a user's head or at least partly implanted in a user's head.

Figure 1C:
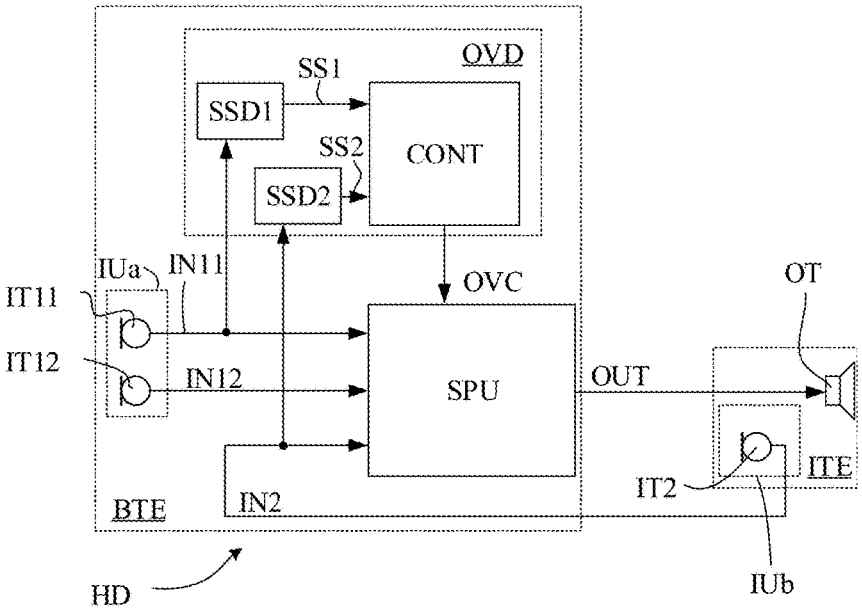
FIG. 1C shows a third embodiment of a hearing device according to the present disclosure.
Figure 1D:
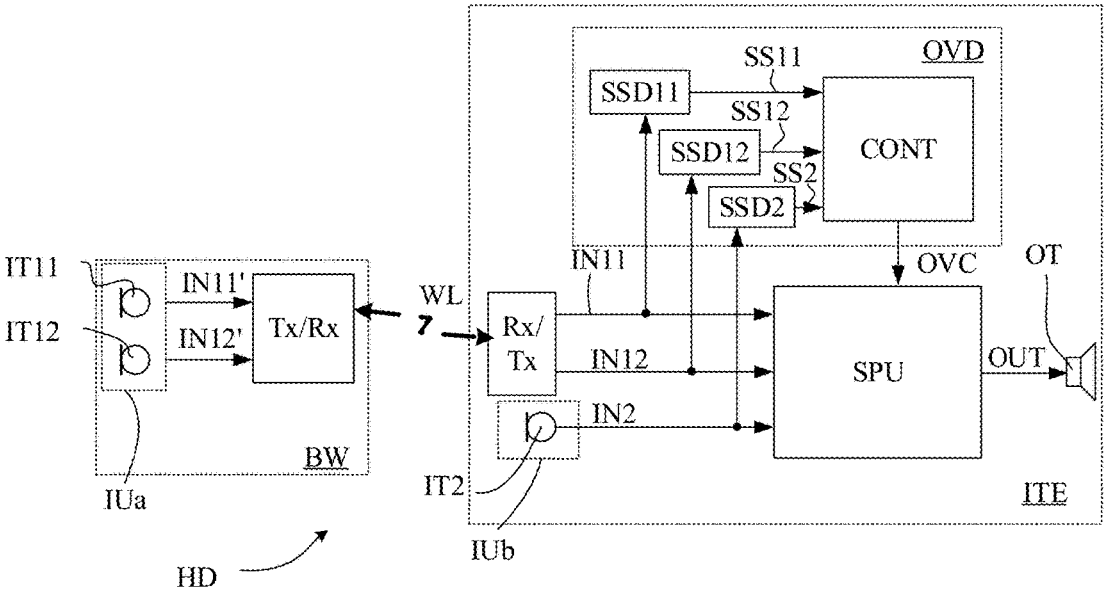
FIG. 1D shows a fourth embodiment of a hearing device according to the present disclosure.

FIGS. 1C and 1D are intended to illustrate different partitions of the hearing device of FIG. 1A, 1B. The following brief discussion of FIG. 1B to 1D is focused on the differences to the embodiment of FIG. 1A. Otherwise, reference is made to the above general description.

FIG. 1B shows an embodiment of a hearing device (HD) as shown in FIG. 1A, but including time-frequency conversion units (t/f) enabling analysis and/or processing of the electric input signals (IN1, IN2) from the input transducers (IT1, IT2, e.g. microphones), respectively, in the frequency domain. The time-frequency conversion units (t/f) are shown to be included in the input unit (IU), but may alternatively form part of the respective input transducers or of the signal processing unit (SPU) or be separate units. The hearing device (HD) further comprises a time-frequency to time conversion unit (f/t), shown to be included in the output unit (OU). Such functionality may alternatively be located elsewhere, e.g. in connection with the signal processing unit (SPU) or the output transducer (OT). The signals (IN1, IN2, OUT) of the forward path between the input and output units (IU, OU) are shown as bold lines and indicated to comprise Na (e.g. 16 or 64 or more) frequency bands (of uniform or different frequency width). The signals (IN1, IN2, SS1, SS2, OVC) of the analysis path are shown as semi-bold lines and indicated to comprise Nb (e.g. 4 or 16 or more) frequency bands (of uniform or different frequency width).

FIG. 1C shows an embodiment of a hearing device (HD) as shown in FIG. 1A or 1B, but the signal strength detectors (SSD1, SSD2) and the control unit (CONT) (forming part of the own voice detection unit (OVD), and the signal processing unit (SPU) are located in a behind-the-ear part (BTE) together with input transducers (microphones IT11, IT12 forming part of input unit part IUa). The second input transducer (microphone IT2 forming part of input unit part IUb) is located in an in-the-ear part (ITE) together with the output transducer (loudspeaker OT forming part of output unit OU).

FIG. 1D illustrates an embodiment of a hearing device (HD), wherein the signal strength detectors (SSDI1, SSD12, SSD2), the control unit (CONT), and the signal processing unit (SPU) are located in the ITE-part, and wherein the input transducers (microphones (IT11, IT12) are located in a body worn part (BW) (e.g. a BTE-part) and connected to respective antenna and transceiver circuitry (together denoted Tx/Rx) for wirelessly transmitting the electric microphone signals IN11' and IN12' to the ITE-part via wireless link WL. Preferably, the body-worn part is adapted to be located at a place on the user's body that is attractive from a sound reception point of view, e.g. on the user's head. The ITE-part comprises the second input transducer (microphone IT2), and antenna and transceiver circuitry (together denoted Rx/Tx) for receiving the wirelessly transmitted electric microphone signals IN11' and IN12' from the BW-part (providing received signals IN11, IN12). The (first) electric input signals IN11, IN12, and the second electric input signal IN2 are connected to the signal unit (SPU). The signal processing unit (SPU) processes the electric input signals and provides a processed output signal (OUT), which is forwarded to output transducer OT and converted to an output sound. The wireless link WL between the BW- and ITE-parts may be based on any appropriate wireless technology. In an embodiment, the wireless link is based on an inductive (near-field) communication link. In a first embodiment, the BW-part and the ITE-part may each constitute self-supporting (independent) hearing devices (e.g. left and right hearing devices of a binaural hearing system). In a second embodiment, the ITE-part may constitute a self-supporting (independent) hearing device, and the BW-part is an auxiliary device that is added to provide extra functionality. In an embodiment, the extra functionality may include one or more microphones of the BW-part to provide directionality and/or alternative input signal(s) to the ITE-part. In an embodiment, the extra functionality may include added connectivity, e.g. to provide wired or wireless connection to other devices, e.g. a partner microphone, a particular audio source (e.g. a telephone, a TV, or any other entertainment sound track). In the embodiment, of FIG. 1D, the signal strength (e.g. level/magnitude) of each of the electric input signals (IN11, IN12, IN2) is estimated by individual signal strength detectors (SSD11, SSD12, SSD2) and their outputs used in the comparison unit to determine a comparison measure indicative of the difference between said signal strength estimates. In an embodiment, an average (e.g. a weighted average, e.g. determined by a microphone location effect) of the signal strengths (here SS11, SS12) of the input transducers (here IT11, IT12) NOT located in or at the ear canal is determined. Alternatively other qualifiers may be applied to the mentioned the signal strengths (here SS11, SS12), e.g. a MAX-function, or a MIN-function.

Figure 2:
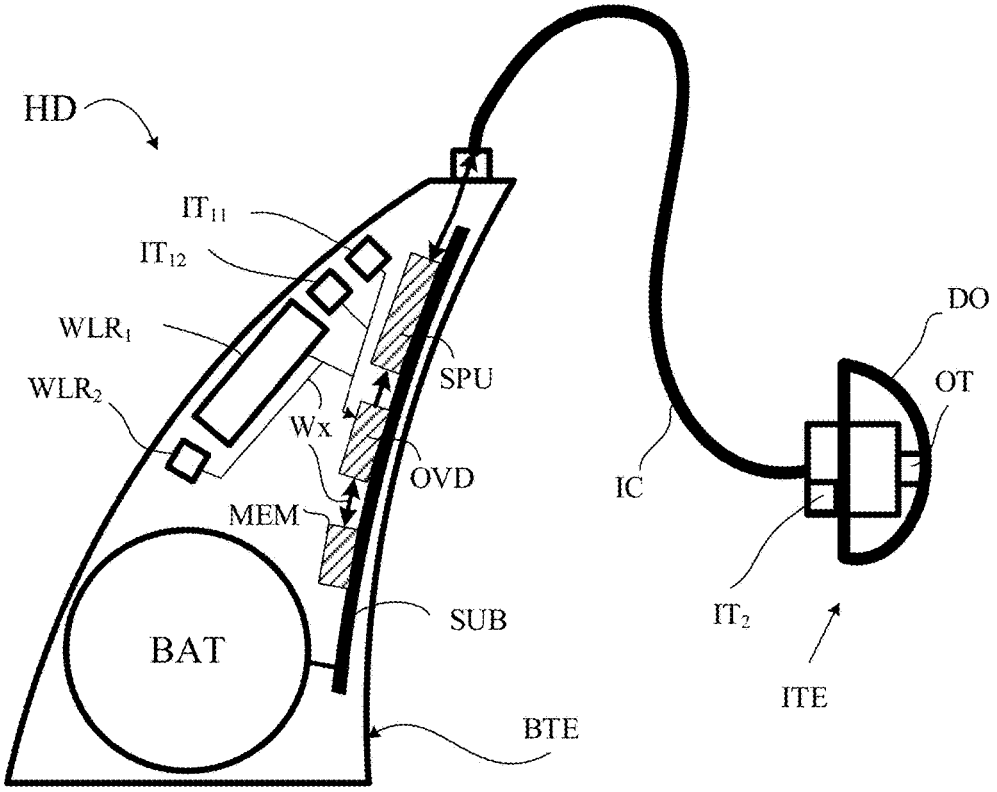
FIG. 2 shows a fifth embodiment of a hearing device according to the present disclosure.

FIG. 2 shows an exemplary hearing device according to the present disclosure. The hearing device (HD), e.g. a hearing aid, is of a particular style (sometimes termed receiver-in-the ear, or RITE, style) comprising a BTE-part (BTE) adapted for being located at or behind an ear of a user and an ITE-part (ITE) adapted for being located in or at an ear canal of a user's ear and comprising an output transducer (OT), e.g. a receiver (loudspeaker). The BTE-part and the ITE-part are connected (e.g. electrically connected) by a connecting element (IC) and internal wiring in the ITE- and BTE-parts (cf. e.g. schematically illustrated as wiring Wx in the BTE-part).

In the embodiment of a hearing device (HD) in FIG. 2, the BTE part comprises an input unit comprising two input transducers (e.g. microphones) ($IT_{11}$, $IT_{12}$) each for providing an electric input audio signal representative of an input sound signal. The input unit further comprises two (e.g. individually selectable) wireless receivers ($WLR_1$, $WLR_2$) for providing respective directly received auxiliary audio input signals (e.g. from microphones in the environment, or from other audio sources, e.g. streamed audio). The BTE-part comprises a substrate SUB whereon a number of electronic components (MEM, OVD, SPU) are mounted, including a memory (MEM), e.g. storing different hearing aid programs (e.g. parameter settings defining such programs) and/or input source combinations ($IT_{11}$, $IT_{12}$, $WLR_1$, $WLR_2$), e.g. optimized for a number of different listening situations. The BTE-part further comprises an own voice detector OVD for providing an own voice detection signal indicative of whether or not the current sound signals comprise the user's own voice. The BTE-part further comprises a configurable signal processing unit (SPU) adapted to access the memory (MEM) and for selecting and processing one or more of the electric input audio signals and/or one or more of the directly received auxiliary audio input signals, based on a currently selected (activated) hearing aid program/parameter setting/(e.g. either automatically selected based on one or more sensors and/or on inputs from a user interface). The configurable signal processing unit (SPU) provides an enhanced audio signal.

The hearing device (HD) further comprises an output unit (OT, e.g. an output transducer) providing an enhanced output signal as stimuli perceivable by the user as sound based on the enhanced audio signal from the signal processing unit or a signal derived therefrom. Alternatively or additionally, the enhanced audio signal from the signal processing unit may be further processed and/or transmitted to another device depending on the specific application scenario.

In the embodiment of a hearing device in FIG. 2, the ITE part comprises the output unit in the form of a loudspeaker (receiver) (OT) for converting an electric signal to an acoustic signal. The ITE-part also comprises a (second) input transducer ($IT_2$, e.g. a microphone) for picking up a sound from the environment as well as from the output transducer (OT). The ITE-part further comprises a guiding element, e.g. a dome, (DO) for guiding and positioning the ITE-part in the ear canal of the user.

The signal processing unit (SPU) comprises e.g. a beamformer unit for spatially filtering the electric input signals and providing a beamformed signal, a feedback cancellation system for reducing or cancelling feedback from the output transducer (OT) to the (second) input transducer (IT2), a gain control unit for providing a frequency and level dependent gain to compensate for the user's hearing impairment, etc. The signal processing unit, e.g. the beamformer unit/and or the gain control unit (cf. e.g. FIG. 3) may e.g. be controlled or influenced by the own voice detection signal.

The hearing device (HD) exemplified in FIG. 2 is a portable device and further comprises a battery (BAT), e.g. a rechargeable battery, for energizing electronic components of the BTE- and ITE-parts. The hearing device of FIG. 2 may in various embodiments implement the embodiments of a hearing device shown in FIGS. 1A, 1B, 1C, 1D, and 3.

In an embodiment, the hearing device, e.g. a hearing aid (e.g. the signal processing unit SPU), is adapted to provide a frequency dependent gain and/or a level dependent compression and/or a transposition (with or without frequency compression) of one or more frequency ranges to one or more other frequency ranges, e.g. to compensate for a hearing impairment of a user.

Figure 3:
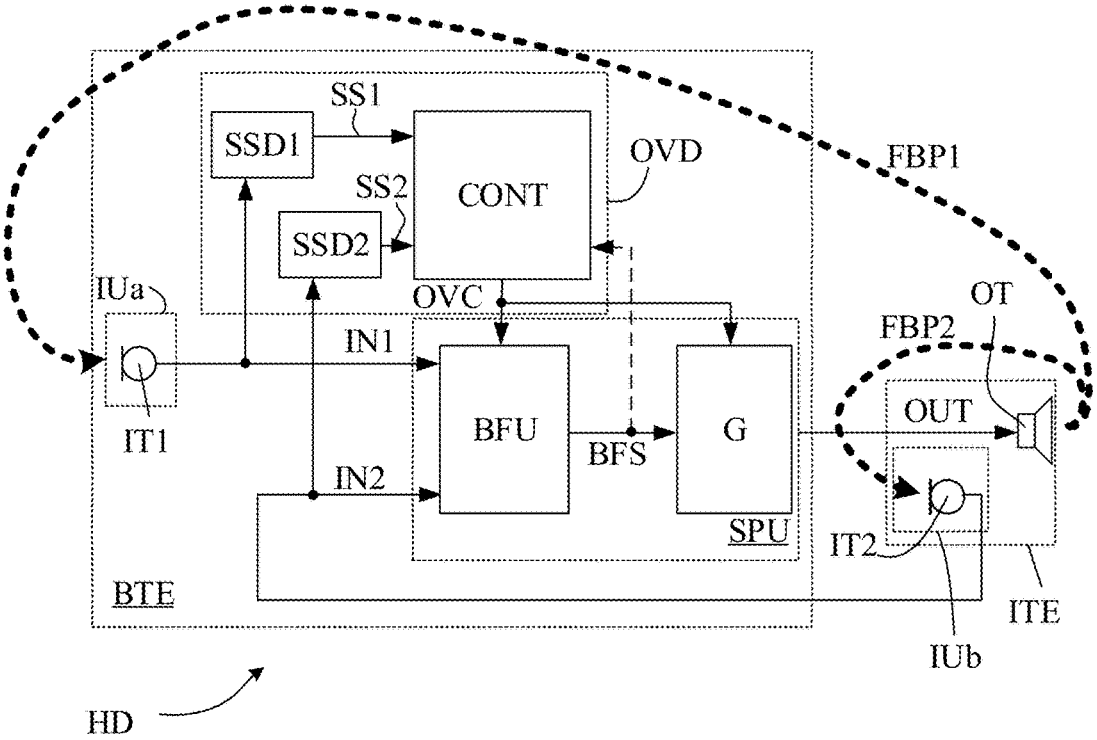
FIG. 3 shows an embodiment of a hearing device according to the present disclosure illustrating a use of the own voice detector in connection with a beamformer unit and a gain amplification unit, and FIG. 4A schematically illustrates the location of microphones relative to the ear canal and ear drum for a typical two-microphone BTE-style hearing aid, and FIG. 4B schematically illustrates the location of first and second microphones relative to the ear canal and ear drum for a two-microphone M2RITE-style hearing aid according to the present disclosure, and FIG. 4C schematically illustrates the location of first and second and third microphones relative to the ear canal and ear drum for a three microphone M2RITE-style hearing aid according to the present disclosure.

FIG. 3 shows an embodiment of a hearing device according to the present disclosure illustrating a use of the own voice detector in connection with a beamformer unit and a gain amplification unit. The hearing devices, e.g. hearing aids, are adapted for being arranged at least partly on or in a user's head. In the embodiments of FIG. 3, the hearing device comprises a BTE part (BTE) adapted for being located behind an ear (pinna) of a user. The hearing device further comprises an ITE-part (ITE) adapted for being located in an ear canal of the user. The ITE-part comprises an output transducer (OT), e.g. a receiver/loudspeaker, and an input transducer (IT2), e.g. a microphone. The BTE-part is operationally connected to the ITE-part. The embodiments of a hearing device shown in FIG. 3 comprises the same functional parts as the embodiment shown in FIG. 1C, except that the BTE-part of the embodiments of FIG. 3 only comprises one input transducer (IT1).

In the embodiment of FIG. 3, the signal processing unit SPU of the BTE-part comprises a beamforming unit (BFU) and a gain control unit (G). The beamforming unit (BFU) is configured to apply (e.g. complex valued, e.g. frequency dependent) weights to the first and second electric input signals IN1 and IN2, providing a weighted combination (e.g. a weighted sum) of the input signals and providing a resulting beamformed signal BFS. The beamformed signal is fed to gain control unit (G) for further enhancement (e.g. noise reduction, feedback suppression, amplification, etc.). The feedback paths from the output transducer (OT) to the respective input transducers IT1 and IT2, are denoted FBP1 and FBP2, respectively (cf. bold, dotted arrows). The feedback signals are mixed with respective signals from the environment. The beamformer unit (BFU) may comprise first (far-field) adjustment units configured to compensate the electric input signals IN1, IN2 for the different location relative to an acoustic source from the far field (e.g. according to the microphone location effect (MLE)). The first input transducer is arranged in the BTE-part e.g. to be located behind the pinna (e.g. at the top of pinna), whereas the second input transducer is located in the ITE-part in or around the entrance to the ear canal. Thereby a maximum directional sensitivity of the beamformed signal may be provided in a direction of a target signal from the environment. Similarly, the beamformer unit (BFU) may comprise second (near-field) adjustment units to compensate the electric input signals IN1, IN2 for the different location relative to an acoustic source from the near-field (e.g. from the output transducer located in the ear canal). Thereby a minimum directional sensitivity of the beamformed signal may be provided in a direction of the output transducer (OT) to the feedback from the output transducer to the input transducers.

The hearing device, e.g. own voice detection unit (OVD), is configured to control the beamformer unit (BFU) and/or the gain control unit in dependence of the own voice detection signal (OVC). In an embodiment, one or more (beamformer) weights of the weighted combination of electric input signals IN1, IN2 or signals derived therefrom is/are changed in dependence of the own voice detection signal (OVC), e.g. in that the weights of the beamformer unit are changed to change en emphasis of the beamformer unit (BFU) from one electric input signal to another (or from a more directional to a less directional (more omni-directional) focus) in dependence of the own voice detection signal (OVC).

In an embodiment, the own voice detection unit is configured to apply a specific own voice beamformer weights to electric input signals that implements an own voice beamformer providing a maximum sensitivity of the beamformer unit/the beamformed signal in a direction from the hearing device towards the user's mouth, when the own voice detection signal indicates that the user's own voice is dominant in the electric input signal(s). A beamformer unit adapted to provide a beamformed signal in a direction from the hearing aid towards the user's mouth is e.g. described in US20150163602A1. In an embodiment, the hearing device is configured to apply the own voice beamformer (pointing towards the user's mouth), when the own voice detector (e.g. based on the level difference measure estimate) indicates that a user's own voice is present, and to use a resulting beamformed signal as an input to the own voice detector (OVC, cf. dashed arrow feeding beamformed signal BFS from the beamformer filtering unit BFU to the own voice detector OVC).

The hearing device, e.g. own voice detection unit (OVD), may further be configured to control the gain control unit (G) in dependence of the own voice detection signal (OVC). In an embodiment, the hearing device is configured to decrease the applied gain based on an indication by the own voice detection unit (OVD) that the current acoustic situation is dominated by the user's own voice.

The embodiment of FIG. 3 may be operated fully or partially in the time domain, or fully or partially in the time-frequency domain (by inclusion of appropriate time-to-time-frequency and time-frequency-to-time conversion units).

In traditional hearing instruments like BTE or RITE styles, where both microphones are located in a BTE-part behind the ear, or ITE styles, where both microphones are in the ear, it can be quite difficult to detect the own voice of the HI user.

In a hearing aid according to the present disclosure, one microphone is placed in the ear canal, e.g. in an ITE-part together with the speaker unit, and another microphone is placed behind the ear, e.g. in a BTE part comprising other functional parts of the hearing aid. This style is termed M2RITE in the present disclosure. In an M2RITE style hearing aid, the microphone distance is variable from person to person and determined by how the hearing instrument is mounted on the users' ear, the user's ear size, etc. This results in a relatively large (but variable) microphone distance, e.g. of 35-60 mm, compared to the traditionally microphone distance (fixed for a given hearing aid type), e.g. of 7-14 mm, of BTE, RITE and ITE style hearing aids. The angle of the microphones may also have an influence of the performance of both own voice detection and own voice pick up.

The difference in the distance of the microphones and the mouth creates the following differences of sound pressure level, SPL, for RITE and M2RITE styles:

As an example, a RITE or BTE style hearing aid (FIG. 4A) with $d_f$=13.5 cm, and $d_r$=14.0 cm=>SPL difference=20*log 10(14/13.5)=0.32 dB. A corresponding example for a M2RITE style hearing aid (FIG. 4B) with $d_f$=10 cm, and $d_r$=14.0 cm=>SPL difference=20*log 10(14/10)=2.9 dB.

Figure 4A:
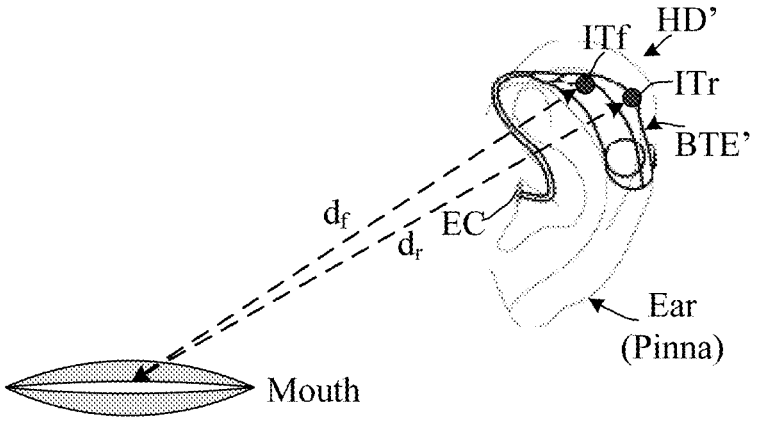

On top of this, the shadow of the pinna will add at least 5 dB higher SPL at the front microphone (IT2, e.g. in an ITE-part) relative to the rear microphone (IT1, e.g. in a BTE-part) at 3-4 kHz, for the M2RITE style (FIG. 4B) and significantly less for the RITE/BTE styles (FIG. 4A).

So a simple indicator of the presence of own voice is the level difference between the two microphones. At low frequencies with high acoustical energy in the speech signal, it could be expected to detect at least 2.5 dB higher level at the front microphone (IT2) than at the rear microphone (IT1), and at 3-4 kHz, at least 7.5 dB difference. This could be combined with a detection of a high modulation index to verify the signal as being speech.

In an embodiment, the phase difference between the signals of the two microphones are included.

In case we want to pick up the own voice for streaming, e.g. during a hands free phone call, the M2RITE microphone positions have a great advantage for creating a directional near field microphone system.

FIG. 4A schematically illustrates the location of microphones (ITf, ITr) relative to the ear canal (EC) and ear drum for a typical two-microphone BTE-style hearing aid (HD'). The hearing aid HD' comprises a BTE-part (BTE') comprising two input transducers (ITf, ITr) (e.g. microphones) located (or accessible for sound) in the top part of the housing (shell) of the BTE-part (BTE'). When mounted at (behind) a user's ear (Ear (Pinna)), the microphones (ITf, ITr) are located so that one (ITf) is more facing the front and one (ITr) is more facing the rear of the user. The two microphones are located a distance $d_f$ and $d_r$, respectively, from the user's mouth (Mouth) (cf. also FIG. 4C). The two distances are of similar size (typically within 50%, such as within 10%) of each other.

Figure 4B:
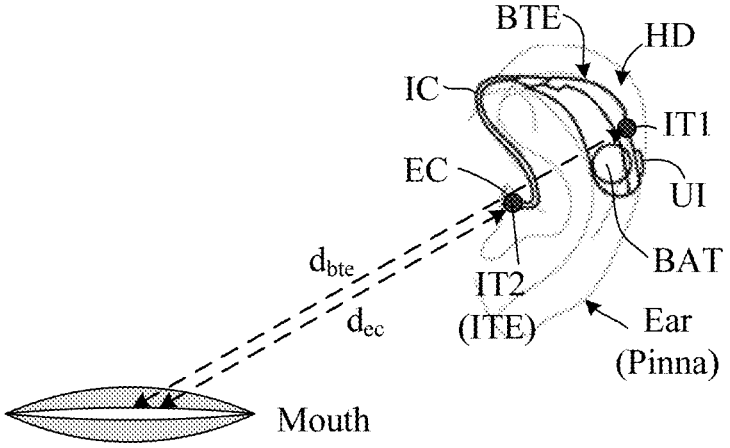

FIG. 4B schematically illustrates the location of first and second microphones (IT1, IT2) relative to the ear canal (EC) and ear drum and to the user's mouth (Mouth) for a two-microphone M2RITE-style hearing aid (HD) according to the present disclosure (and as e.g. shown and described in connection with FIG. 2). One microphone (IT2) is located (in an ITE-part (ITE)) at the ear canal entrance (EC). Another microphone (IT1) is located in or on a BTE-part (BTE) located behind an ear (Ear (Pinna)) of the user. The distance between the two microphones (IT1, IT2) is d. The distance from the user's mouth to the individual microphones, the microphone (IT2) at the ear canal entrance (EC) and the BTE-microphone (IT1), is indicated by $d_{ec}$ and $d_{bte}$, respectively. The difference in distance ($d_{bte}-d_{ec}$) from the user's mouth to the individual microphones is roughly equal to the distance d between the microphones. Hence, a substantial difference in signal level (or power or energy) received by the first and second microphones (IT1, IT2) from a sound generated by the user (the user's own voice) will be experienced. The hearing aid (HD), here the BTE-part (BTE), is shown to comprise a battery (BAT) for energizing the hearing aid, and a user interface (UI), here a switch or button on the housing of the BTE-part. The user interface is e.g. configured to allow a user to influence functionality of the hearing aid. It may alternatively (or additionally) be implemented in a remote control device (e.g. as an APP of a smartphone or similar device).

Figure 4C:
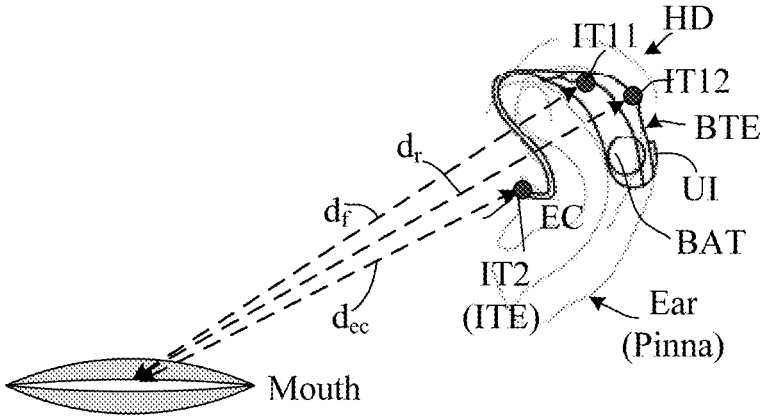

FIG. 4C schematically illustrates the location of first, second and third microphones (IT11, IT12, IT2) relative to the ear canal (EC) and ear drum and to the user's mouth (Mouth) for a three-microphone (M3RITE-)style hearing aid (HD) according to the present disclosure (and as e.g. shown and described in connection with FIG. 2). The embodiment of FIG. 4C provides a hybrid solution between a prior art two-microphone solution with two microphones (IT11, IT12) located on a BTE-part (as shown in FIG. 4A) and a one- (MRITE) or two-microphone (M2RITE) solution comprising a microphone (112) located at the ear canal (as shown in FIG. 4B).

Figure 5:
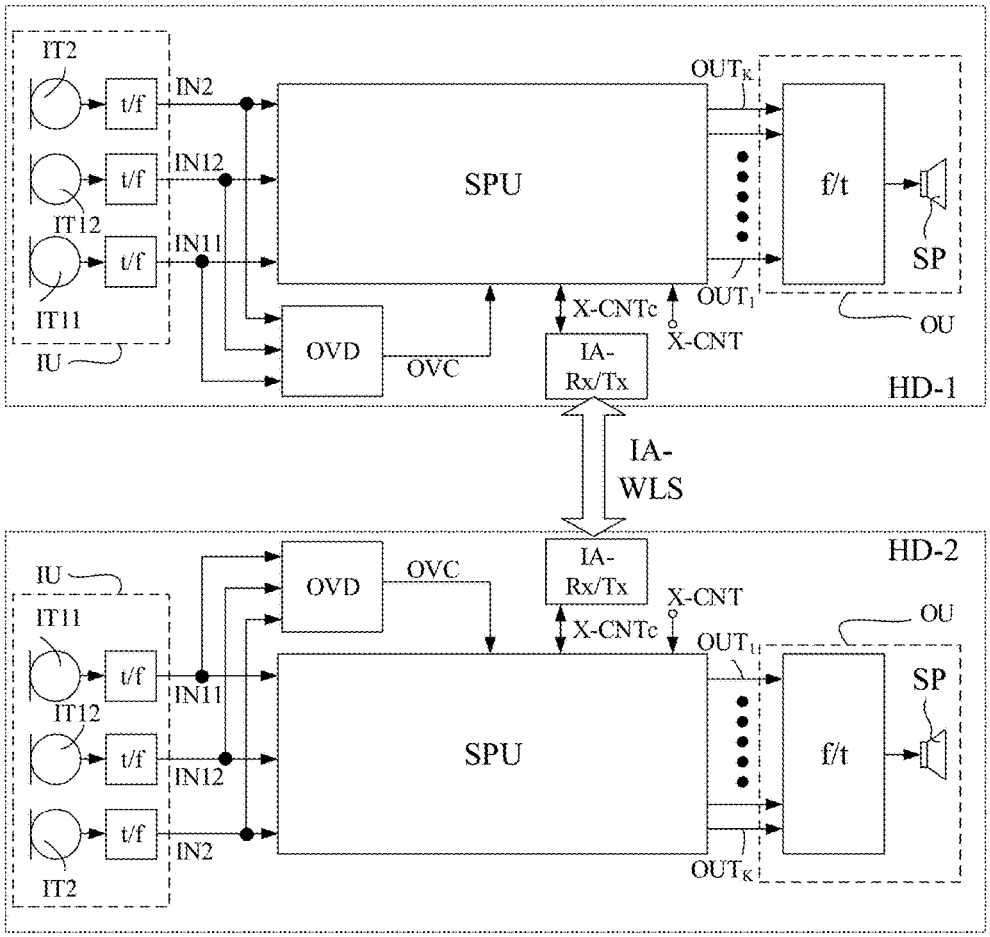
FIG. 5 shows an embodiment of a binaural hearing system comprising first and second hearing devices.

FIG. 5 shows an embodiment of a binaural hearing system comprising first and second hearing devices. The first and second hearing devices are configured to exchange data (e.g. own voice detection status signals) between them via an interaural wireless link (IA-WLS). Each of the first and second hearing devices (HD-1, HD-2) are hearing devices according to the present disclosure, e.g. comprising functional components as described in connection with FIG. 1B. Instead of 2 input transducers (one first input transducer (IT1) and 1 second input transducer (IT2)), each of the hearing devices of the embodiment of FIG. 5 (input unit IU) comprise 3 input transducers 2 first input transducers (IT11, IT22) and one second input transducer (IT2). In FIG. 5, each input transducer comprises a microphone. As in the embodiment of FIG. 1B, each input transducer path comprises a time-frequency conversion unit (t/f), e.g. an analysis filter bank for providing an input signal in a number (K) of frequency sub-bands, and the output unit (OU) comprises a time-frequency to time conversion unit (f/t), e.g. a synthesis filter bank, to provide the resulting output signal in the time domain from the K frequency sub-band signals ($OUT_1$, . . . , $OUT_K$). In the embodiment of FIG. 5, the output transducer of the output unit of each hearing device comprises a loudspeaker (receiver) to convert an electric output signal to a sound signal. The own voice detector (OVD) of each hearing device receives the three electric input signals IN11, IN12, and IN2 from the two first microphones (IT11, IT12) and the second microphone (IT2), respectively. The input signals are provided in a time-frequency representation (k,m) in a number K of frequency sub-bands k at different time instances m. The own voice detector (OVD) feeds a resulting own voice detection signal OVC to the signal processing unit. The own voice detection signal OVC is based on the locally received electric input signals (including a signal strength difference measure according to the present disclosure). In addition, each of the first and second hearing devices (HD-1, HD-2) comprises antenna and transceiver circuitry (IA-Rx/Tx) for establishing a wireless communication link (IA-WLS) between them allowing an exchange of data (via the signal processing unit, cf. signals X-CNTc), including own voice detection data (e.g. the locally detected own voice detection signal), and optionally other information and control signals (and optionally audio signals or parts thereof, e.g. one or more selected frequency bands or ranges). The exchanged signals are fed to the respective signal processing units (SPU) and used there to control processing (signals X-CNTc). In particular, the exchange of own voice detection data may be used to make an own voice detection more robust, e.g. to be dependent on both hearing devices detecting the user's own voice. A further processing control or input signal is indicated as signal X-CNT, e.g. from one or more internal or external detectors (e.g. from an auxiliary device, e.g. a smartphone).

Figure 6A:
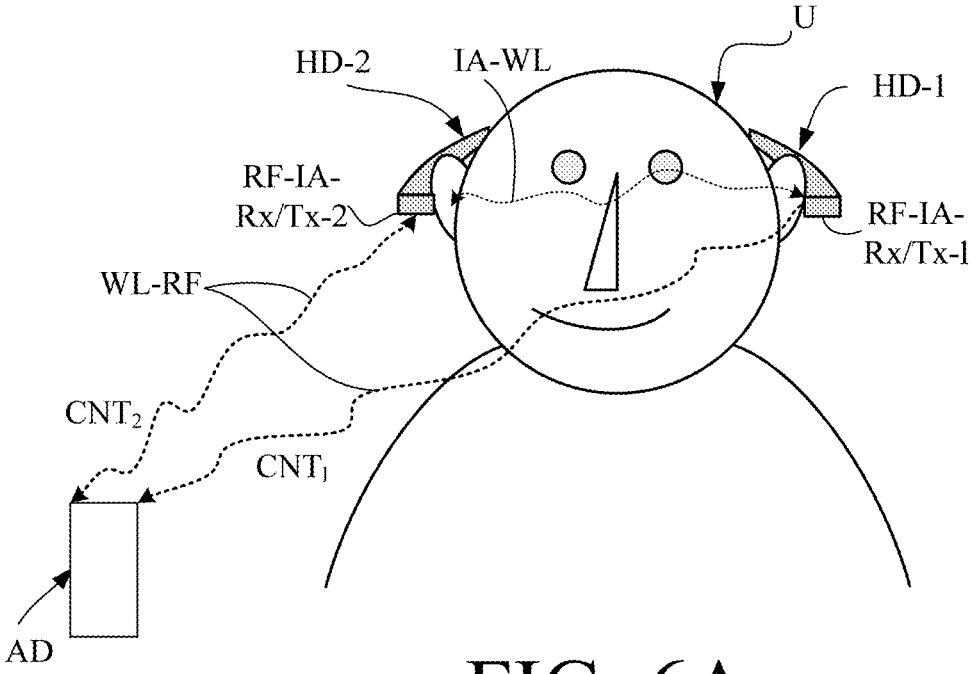
FIGS. 6A and 6B illustrate an exemplary application scenario of an embodiment of a hearing system according to the present disclosure, where
Figure 6B:
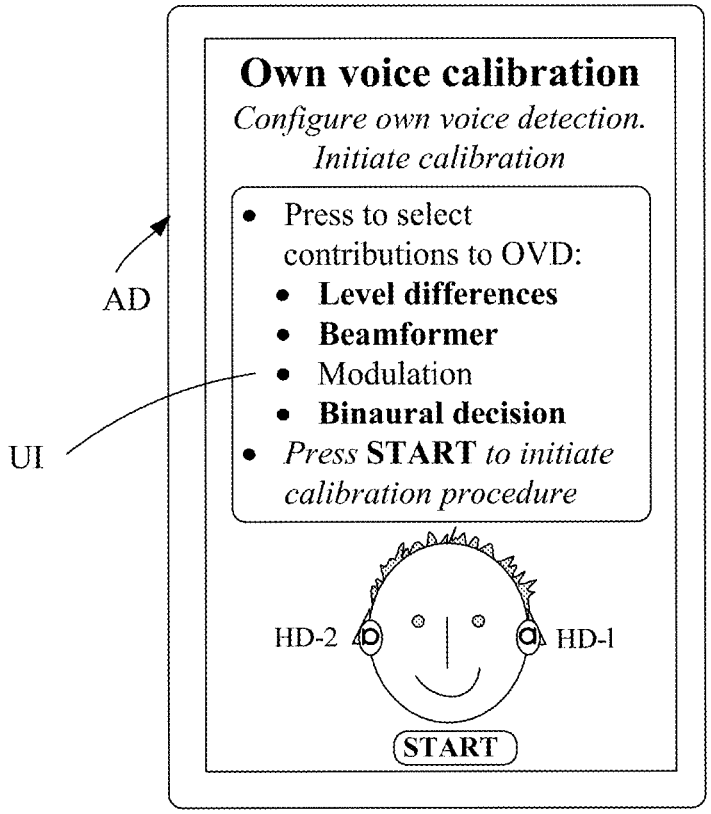

FIG. 6A, 6B show an exemplary application scenario of an embodiment of a hearing system according to the present disclosure. FIG. 6A illustrates a user, a binaural hearing aid system and an auxiliary device during a calibration procedure of the own voice detector, and FIG. 6B illustrates the auxiliary device running an APP for initiating the calibration procedure. The APP is a non-transitory application (APP) comprising executable instructions configured to be executed on the auxiliary device to implement a user interface for the hearing device(s) or the hearing system. In the illustrated embodiment, the APP is configured to run on a smartphone, or on another portable device allowing communication with the hearing device(s) or the hearing system.

FIG. 6A shows an embodiment of a binaural hearing aid system comprising left (second) and right (first) hearing devices (HD-1, HD-2) in communication with a portable (handheld) auxiliary device (AD) functioning as a user interface (UI) for the binaural hearing aid system. In an embodiment, the binaural hearing aid system comprises the auxiliary device AD (and the user interface UI). The user interface UI of the auxiliary device AD is shown in FIG. 6B. The user interface comprises a display (e.g. a touch sensitive display) displaying a user of the hearing system and a number of predefined locations of the calibration sound source relative to the user. Via the display of the user interface (under the heading Own voice calibration. Configure own voice detection. Initiate calibration), the user U is instructed to Press to select contributions to OVD
- Level differences
- OV beamformer
- Modulation
- Binaural decision Press START to initiate calibration procedure These instructions should prompt the user to select one or more of the (in this example) four possible contributors to the own voice detection: Level differences (according to the present disclosure), OV beamformer (direct beamformer towards mouth, if own voice is indicated by other indicator, e.g. level differences), Modulation (qualify own voice decision based on a modulation measure), and Binaural decision (qualify own voice decision based on own voice detection data from a contra-lateral hearing device. Here, 3 of them are selected as indicated by the bold highlight of Level differences, OV beamformer, and Binaural decision.

Other appropriate functionality of the APP may be to 'Learn your voice', e.g. to allow characteristic features (e.g. fundamental frequency, frequency spectrum, etc.) of a particular user's own voice to be identified. Such learning procedure may e.g. form part of the calibration procedure.

When the own voice detection has been configured, a calibration of the selected contributing 'detectors' can be initiated by pressing START. Following the initiation of calibration, the APP will instruct the user what to do, e.g. including providing examples of own voice. In an embodiment, the user is informed via the user interface if a current noise level is above a noise level threshold. Thereby, the user may be discouraged from executing the calibration procedure while a noise level is too high.

In the embodiment, the auxiliary device AD comprising the user interface UI is adapted for being held in a hand of a user (U).

In the embodiment of FIG. 6A, wireless links denoted IA-WL (e.g. an inductive link between the hearing left and right assistance devices) and WL-RF (e.g. RF-links (e.g. Bluetooth) between the auxiliary device AD and the left HD-1, and between the auxiliary device AD and the right HD-2, hearing device, respectively) are indicated (implemented in the devices by corresponding antenna and transceiver circuitry, indicated in FIG. 6A in the left and right hearing devices as RF-IA-Rx/Tx-1 and RF-IA-Rx/Tx-2, respectively).

In an embodiment, the auxiliary device AD is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device. In an embodiment, the auxiliary device is or comprises a remote control for controlling functionality and operation of the hearing device(s). In an embodiment, the function of a remote control is implemented in a SmartPhone, the SmartPhone possibly running an APP allowing to control the functionality of the audio processing device via the SmartPhone (the hearing device(s) comprising an appropriate wireless interface to the SmartPhone, e.g. based on Bluetooth or some other standardized or proprietary scheme).

Figure 7A:
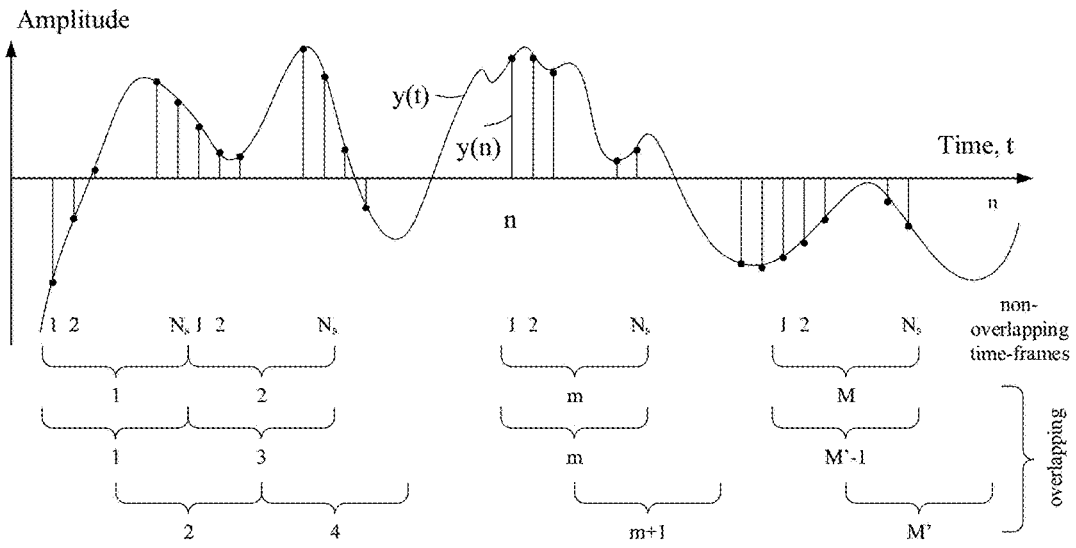
FIG. 7A schematically shows a time variant analogue signal (Amplitude vs time) and its digitization in samples, the samples being arranged in a number of time frames, each comprising a number $N_s$ of samples.

FIG. 7A schematically shows a time variant analogue signal (Amplitude vs time) and its digitization in samples, the samples being arranged in a number of time frames, each comprising a number $N_s$ of digital samples. FIG. 7A shows an analogue electric signal (solid graph), e.g. representing an acoustic input signal, e.g. from a microphone, which is converted to a digital audio signal in an analogue-to-digital (AD) conversion process, where the analogue signal is sampled with a predefined sampling frequency or rate $f_s$, $f_s$ being e.g. in the range from 8 kHz to 40 kHz (adapted to the particular needs of the application) to provide digital samples y(n) at discrete points in time n, as indicated by the vertical lines extending from the time axis with solid dots at its endpoint coinciding with the graph, and representing its digital sample value at the corresponding distinct point in time n. Each (audio) sample y(n) represents the value of the acoustic signal at n (or $t_n$) by a predefined number $N_b$ of bits, $N_b$ being e.g. in the range from 1 to 48 bit, e.g. 24 bits. Each audio sample is hence quantized using $N_b$ bits (resulting in $2^{Nb}$ different possible values of the audio sample).

In an analogue to digital (AD) process, a digital sample y(n) has a length in time of $1/f_s$, e.g. 50 μs, for $f_s$=20 kHz. A number of (audio) samples $N_s$ are e.g. arranged in a time frame, as schematically illustrated in the lower part of FIG. 1A, where the individual (here uniformly spaced) samples are grouped in time frames (1, 2, . . . , $N_s$)). As also illustrated in the lower part of FIG. 7A, the time frames may be arranged consecutively to be non-overlapping (time frames 1, 2, . . . , m, . . . , M) or overlapping (here 50%, time frames 1, 2, . . . , m, . . . , M'), where m is time frame index. In an embodiment, a time frame comprises 64 audio data samples. Other frame lengths may be used depending on the practical application.

Figure 7B:
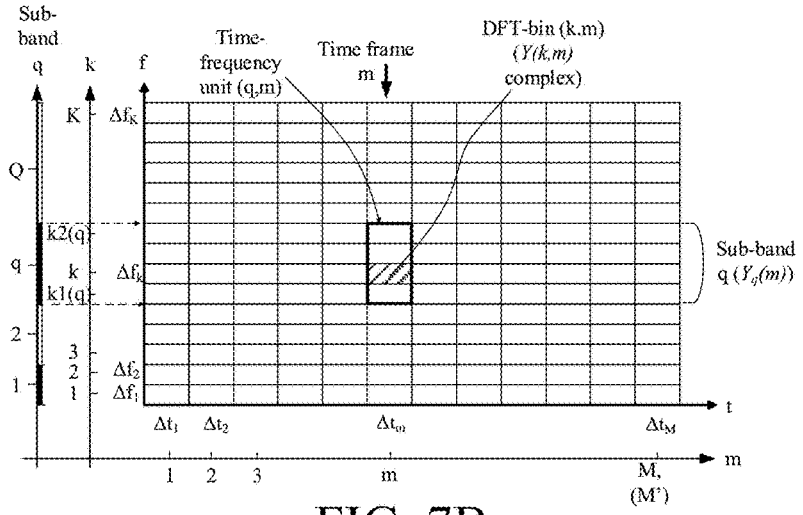
FIG. 7B illustrates a time-frequency map representation of the time variant electric signal of FIG. 7A.

FIG. 7B schematically illustrates a time-frequency representation of the (digitized) time variant electric signal y(n) of FIG. 7A. The time-frequency representation comprises an array or map of corresponding complex or real values of the signal in a particular time and frequency range. The time-frequency representation may e.g. be a result of a Fourier transformation converting the time variant input signal y(n) to a (time variant) signal Y(k,m) in the time-frequency domain. In an embodiment, the Fourier transformation comprises a discrete Fourier transform algorithm (DFT). The frequency range considered by a typical hearing aid (e.g. a hearing aid) from a minimum frequency $f_{min}$ to a maximum frequency $f_{max}$ comprises a part of the typical human audible frequency range from 20 Hz to 20 kHz, e.g. a part of the range from 20 Hz to 12 kHz. In FIG. 7B, the time-frequency representation Y(k,m) of signal y(n) comprises complex values of magnitude and/or phase of the signal in a number of DFT-bins (or tiles) defined by indices (k,m), where k=1, . . . , K represents a number K of frequency values (cf. vertical k-axis in FIG. 7B) and m=1, . . . , M (M') represents a number M (M') of time frames (cf. horizontal m-axis in FIG. 7B). A time frame is defined by a specific time index in and the corresponding K DFT-bins (cf. indication of Time frame m in FIG. 7B). A time frame m represents a frequency spectrum of signal x at time m. A DFT-bin or tile (k,m) comprising a (real) or complex value Y(k,m) of the signal in question is illustrated in FIG. 7B by hatching of the corresponding field in the time-frequency map. Each value of the frequency index k corresponds to a frequency range $\Delta f_k$, as indicated in FIG. 7B by the vertical frequency axis f. Each value of the time index m represents a time frame. The time $\Delta t_m$ spanned by consecutive time indices depend on the length of a time frame and the degree of overlap between neighbouring time frames (cf. horizontal t-axis in FIG. 7B).

In the present application, a number Q of (non-uniform) frequency sub-bands with sub-band indices q=1, 2, . . . , J is defined, each sub-band comprising one or more DFT-bins (cf. vertical Sub-band q-axis in FIG. 7B). The $q^{th}$ sub-band (indicated by Sub-band q ($Y_q$(m)) in the right part of FIG. 7B) comprises DFT-bins (or tiles) with lower and upper indices k1($q$) and k2($q$), respectively, defining lower and upper cut-off frequencies of the $q^{th}$ sub-band, respectively. A specific time-frequency unit (q,m) is defined by a specific time index m and the DFT-bin indices k1($q$)-k2($q$), as indicated in FIG. 7B by the bold framing around the corresponding DFT-bins (or tiles). A specific time-frequency unit (q,m) contains complex or real values of the $q^{th}$ sub-band signal $Y_q$(m) at time m. In an embodiment, the frequency sub-bands are third octave bands. $\omega_q$ denote a center frequency of the $q^{th}$ frequency band.

Figure 8:
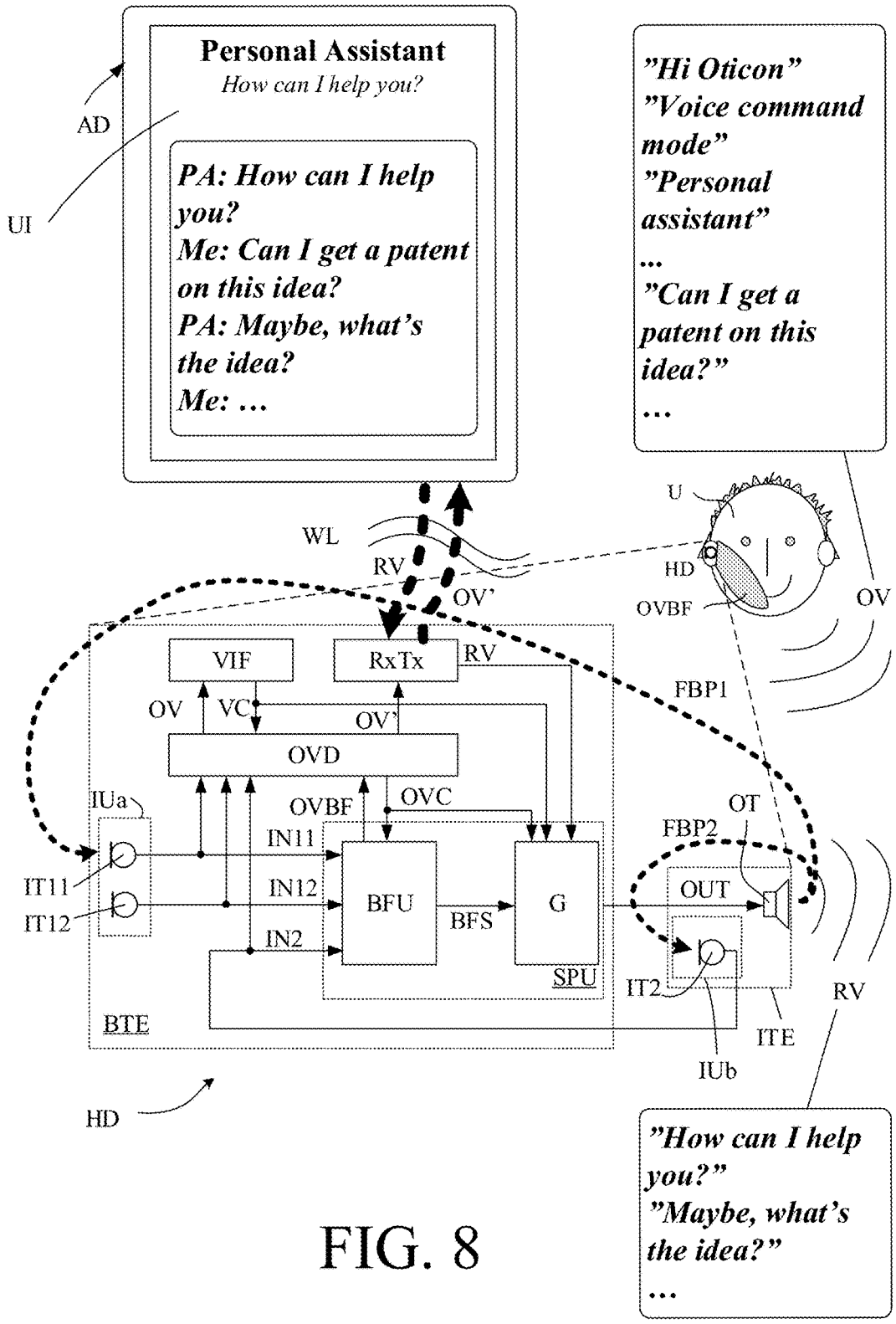
FIG. 8 illustrates an exemplary application scenario of an embodiment of a hearing system according to the present disclosure, where the hearing system comprises voice interface used to communicated with a personal assistant of another device.

FIG. 8 illustrates an exemplary application scenario of an embodiment of a hearing system according to the present disclosure, where the hearing system comprises voice interface used to communicated with a personal assistant of another device, e.g. to implement a 'voice command mode'. The hearing device (HD) in the embodiment of FIG. 8 comprises the same elements as illustrated and described in connection with FIG. 3 above.

In the context of the present scenario, however, the own voice detector (OVD) may be an embodiment according to the present disclosure (based on level differences between microphone signals), but may be embodied in many other ways e.g. (modulation, jaw movement, bone vibration, residual volume microphone, etc.).

Differences to the embodiment of FIG. 3 are described in the following. The BTE part comprises two input transducers, e.g. microphones (IT11, IT12) forming part of the input unit (IUa), as also described in connection with FIG. 1C, 1D, 2, 4C, 5. Signals from all three input transducers are shown to be fed to the own voice detector (OVD) and to the beamformer filtering unit (BFU). The detection of own voice (e.g. represented by signal OVC) may be based on one, more or all microphone signals (IN11, IN12, IN2) depending on the detection principle and the application in question.

The beamformer filtering unit is configured to provide a number of beamformers (beamformer patterns or beamformed signals), e.g. based on predetermined or adaptively determined beamformer weights. The beamformer filtering unit comprises specific own voice beamformer weights that implements an own voice beamformer providing a maximum sensitivity of the beamformer unit/the beamformed signal in a direction from the hearing device towards the user's mouth. A resulting own voice beamformer of signal (OVBF) is provided by the beamformer filtering unit (or by the own voice detector (OVD) in the form of signal OV) when the own voice beamformer weights are applied to the electric input signals (IN11, IN12, IN2). The own voice signal (OV) is fed to a voice interface (VIF), e.g. continuously, or subject to certain criteria, e.g. in specific modes of operation, and/or subject to the detection of the user's voice in the microphone signal(s).

The voice interface (VIF) is configured to detect a specific voice activation word or phrase or sound based on own voice signal OV. The voice interface comprise a voice detector configured to detected a limited number of words or commands ('key words'), including the specific voice activation word or phrase or sound. The voice detector may comprise a neural network, e.g. trained to the user's voice, while speaking at least some of said limited number of words or commands. The voice interface (VIF) provides a control signal VC to the own voice detector (OVD) and to the processor (G) of the forward path in dependence of a recognized word or command in the own voice signal OV. The control signal VC may e.g. be used to control a mode of operation of the hearing device, e.g. via the own voice detector (OVD) and/or via the processor (G) of the forward path.

The hearing device of FIG. 8 further comprises antenna and transceiver circuitry (RxTx) coupled to the own voice detector (OVD) and to the processor of the forward path (SPU, e.g. G). The antenna and transceiver circuitry (RxTx) is configured to establish a wireless link (WL), e.g. an audio link, to an auxiliary device (AD) comprising remote processor, e.g. a smartphone or similar device, configured to execute an APP implementing or forming part of a user interface (UI) for the hearing device (HD) or system.

The hearing device or system is configured to allow a user to activate and/or deactivate one or more specific modes of operation of the hearing device via the voice interface (VIF). In the scenario of FIG. 8, the user's own voice OV is picked up by the input transducers (IT11, IT12, IT2) of the hearing device (HD), via the own voice beamformer (OVBF), see insert (in the middle left part of FIG. 8) of the user (U) wearing the hearing device (or system (HD). The user's voice OV' (or parts, e.g. time or frequency segments thereof) may, controlled via the voice interface (VIF, e.g. via signal VC) be transmitted from the hearing device (HD) via the wireless link (WL) to the communication device (AD). Further, an audio signal e.g. a voice signal, RV, may be received by the hearing system, via the wireless link WL, e.g. from the auxiliary device (AD). The remote voice RV is fed to the processor (G) for possible processing (e.g. adaptation to a hearing profile of the user) and may in certain modes of operation be presented to the user (U) of the hearing system.

The configuration of FIG. 8 may e.g. be used in a 'telephone mode', where the received audio signal RV is a voice of a remote speaker of a telephone conversation, or in a 'voice command mode', as indicated in the screen of the auxiliary device and the speech boxes indicating own voice OV and remote voice RV.

A mode of operation may e.g. be initiated by a specific spoken (activation) command (e.g. 'telephone mode') following the voice interphase activation phrase (e.g. 'Hi Oticon'). In this mode of operation, the hearing device (HD) is configured to wirelessly receive an audio signal RV from a communication device (AD), e.g. a telephone. The hearing device (HD) may further be configured to allow a user to deactivate a current mode of operation via the voice interface by a spoken (de-activation) command (e.g. 'normal mode') following the voice interface activation phrase (e.g. 'Hi Oticon'). As illustrated in FIG. 8, the hearing device (HD) is configured to allow a user to activate and/or deactivate a personal assistant of another device (AD) via the voice interface (VIF) of the hearing device (HD). Such mode of operation, here termed 'voice command mode' (and activated by corresponding spoken words), is a mode of operation where the user's voice OV' is transmitted to a voice interface of another device (here AD), e.g. a smartphone, and activating a voice interface of the other device, e.g. to ask a question to a voice activated personal assistant provided by the other device.

In the example of FIG. 8, a dialogue between the user (U) and the personal assistant (e.g. 'Siri' or 'Genie') starts activating the voice interface (VIF) of the hearing device (HD) by user spoken words "Hi Oticon" and "Voice command mode" and "Personal assistant". "Hi Oticon" activates the voice interface. "Voice command mode" sets the hearing device in 'voice command mode', which results in the subsequent spoken words picked up by the own voice beamformer OVBF being transmitted to the auxiliary device via the wireless link (WL). "Personal assistant" activates the voice interface of the auxiliary device, and subsequent received words (here "Can I get a patent on this idea?") are interpreted by the personal assistant and replied to (here "Maybe, what's the idea?") according to the options available to the personal assistant in question, e.g. involving application of a neural network (e.g. a deep neural network, DNN), e.g. located on a remote server or implemented as a 'cloud based service'. The dialogue as interpreted and provided by the auxiliary device (AD) is shown on the 'Personal Assistant' APP-screen of the user interface (UI) of the auxiliary device (AD). The outputs (questions replies) from the personal assistant of the auxiliary device are forwarded as audio (signal RV) to the hearing device and fed to the output unit (OT, e.g. a loudspeaker) and presented to the user as stimuli perceivable by the user as sound representing "Flow can I help you?" and "Maybe, what's the idea?".

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

US20150163602A1 (OTICON) Nov. 6, 2015
EP2835987A1 (OTICON) Nov. 2, 2015

The invention claimed is:

1. A hearing device adapted for being arranged at least partly on a user's head or at least partly implanted in a user's head, the hearing device comprising an input unit for providing a multitude of electric input signals representing sound in the environment of the user, a signal processing unit providing a processed signal based on one or more of said multitude of electric input signals, and an output unit comprising an output transducer for converting said processed signal or a signal originating therefrom to a stimulus perceivable by said user as sound;

the input unit comprising at least one first input transducer for picking up a sound signal from the environment and providing respective at least one first electric input signal, and a first signal strength detector for providing a first signal strength estimate of the at least one first electric input signal, the at least one first input transducer being located on the head, away from the ear canal of the user;

a second input transducer for picking up a sound signal from the environment and providing a second electric input signal, and a second signal strength detector for providing a second signal strength estimate of the second electric input signal, the second input transducer being located at or in an ear canal of the user, the hearing device further comprising an own voice detector comprising a comparison unit operationally coupled to the first and second signal strength detectors and configured to compare the first and second signal strength estimates, and to provide a signal strength comparison measure indicative of the difference between said signal strength estimates; and a control unit for providing an own voice detection signal indicative of a user's own voice being present or not present in the current sound in the environment of the user, the own voice detection signal being dependent on said signal strength comparison measure.

2. A hearing device according to claim 1 wherein the at least one first input transducer comprises two first input transducers.

3. A hearing device according to claim 1 wherein the signal strength comparison measure comprises an algebraic difference between the first and second signal strengths, and the own voice detection signal is taken to be indicative of a user's own voice being present, when the signal strength at the second input transducer is 2.5 dB or higher than the signal strength at the at least one first input transducer.

4. A hearing device according to claim 1 comprising an analysis filter bank to provide a signal in a time-frequency representation comprising a number of frequency sub-bands.

5. A hearing device according to claim 4 wherein said signal strength comparison measure is based on a difference between the first and second signal strength estimates in a number of frequency sub-bands, wherein the first and second signal strength estimates are weighted on a frequency band level.

6. A hearing device according to claim 4 configured to provide that a, possibly customized, preferred frequency range comprising one or more frequency bands providing maximum difference in signal strength between the first and second input transducers is weighted higher than other frequency bands in the signal strength comparison measure.

7. A hearing device according to claim 1 comprising a modulation detector for providing a measure of modulation of a current electric input signal, and wherein the own voice detection signal is dependent on said measure of modulation in addition to said signal strength comparison measure.

8. A hearing device according to claim 1 comprising a beamformer filtering unit configured to receive said at least one first electric input signal(s) and said second electric input signal and to provide a spatially filtered signal in dependence thereof.

9. A hearing device according to claim 1 comprising a pre-defined and/or adaptively updated own voice beamformer focused on the user's mouth.

10. A hearing device according to claim 9 wherein the hearing device is configured so that said own voice beamformer, at least in a specific mode of operation of the hearing device, is activated and ready to provide an estimate of the user's own voice for transmission to another device, or in other modes, where a user's own voice is requested.

11. A hearing device according to claim 1 comprising an analysis unit for analyzing a user's own voice and for identifying characteristics thereof.

12. A hearing device according to claim 1 constituting or comprising a hearing aid, a headset, an ear protection device or a combination thereof.

13. A hearing device according to claim 12 comprising a part, the ITE part, comprising a loudspeaker and said second input transducer, wherein the ITE part is adapted for being located at or in an ear canal of the user and a part, the BTE-part, comprising a housing adapted for being located behind or at an ear of the user, where a first input transducer is located.

14. A hearing device according to claim 1 comprising a controllable vent exhibiting a controllable vent size, wherein the hearing device is configured to use the own voice detector to control a vent size of the hearing device.

15. A hearing device according to claim 1 comprising a voice interface configured to detect a specific voice activation word or phrase or sound.

16. A hearing device according to claim 15 configured to allow a user to activate and/or deactivate one or more specific modes of operation, of the hearing device via the voice interface.

17. A hearing device, wherein according to claim 16 configured to implement a selectable voice command mode of operation activated via the voice interface, where the user's voice is transmitted to a voice interface of another device and activating a voice interface of the other device.

18. A binaural hearing system comprising first and second hearing devices according to claim 1, wherein each of the first and second hearing devices comprises antenna and transceiver circuitry allowing a communication link between them to be to established.

19. A method of detecting a user's own voice in a hearing device, the method comprising providing a multitude of electric input signals representing sound in the environment of the user, including providing at least one first electric input signal from at least one first input transducer located on the head, away from the ear canal of the user; and providing a second electric input signal from a second input transducer located at or in an ear canal of the user;

providing a processed signal based on one or more of said multitude of electric input signals, and converting said processed signal or a signal originating therefrom to a stimulus perceivable by said user as sound;

providing a first signal strength estimate of the at least one first electric input signal;

providing a second signal strength estimate of the second electric input signal;

comparing the first and second signal strength estimates, and providing a signal strength comparison measure indicative of the difference between said first and second signal strength estimates; and providing an own voice detection signal indicative of a user's own voice being present or not present in the current sound in the environment of the user, the own voice detection signal being dependent on said signal strength comparison measure.

20. A non-transitory storage medium having stored thereon an application storing a processor-executable program that, when executed by a processor of an auxiliary device, implements a user interface process for a hearing device as defined in claim 1 or a binaural hearing system as defined in claim 18, the user interface process comprising:

exchanging information with the hearing device or with the binaural hearing system;

providing a graphical interface configured to allow a user to calibrate an own voice detector of the hearing device or of the binaural hearing system; and executing, based on input from a user via the user interface, at least one of:

configuring the own voice detector; and initiating a calibration of the own voice detector.

21. A hearing device according to claim 1, wherein the at least one first input transducer is located at or behind an ear of the user.

22. A hearing device according to claim 10, wherein said transmission to another device is during a telephone mode.

23. A hearing device according to claim 14 wherein the hearing device is configured to use the own voice detector to control a vent size of the hearing device so that the vent size is increased when a user's own voice is detected and decreased again when the user's own voice is no longer detected.

24. A hearing device according to claim 16 wherein the one or more specific modes of operation includes a telephone mode, and a voice command mode.

25. A hearing device according to claim 17 wherein the another device is a smartphone and the user's voice is transmitted to a voice interface of the smartphone to activate a voice interface of the smartphone to ask a question to a voice activated personal assistant provided by the smartphone.

* * * * *